US006206108B1

(12) United States Patent
MacDonald et al.

(10) Patent No.: US 6,206,108 B1
(45) **Date of Patent: *Mar. 27, 2001**

(54) DRILLING SYSTEM WITH INTEGRATED BOTTOM HOLE ASSEMBLY

(75) Inventors: Robert P. MacDonald, Houston, TX (US); Volker Krueger, Celle (DE); Hatem N. Nasr, Houston, TX (US); John W. Harrell, Spring, TX (US); Roger W. Fincher, Conroe, TX (US)

(73) Assignee: Baker Hughes Incorporated, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/955,930

(22) Filed: Oct. 22, 1997

Related U.S. Application Data

(63) Continuation-in-part of application No. 08/371,879, filed on Jan. 12, 1995, and a continuation-in-part of application No. 08/570,838, filed on Dec. 12, 1996, now Pat. No. 5,812,068, and a continuation-in-part of application No. 08/734,935, filed on Oct. 22, 1996, now Pat. No. 5,842,149.

(51) Int. Cl.[7] ..... E21B 44/00; E21B 47/00

(52) U.S. Cl. ..... 175/24; 175/40; 175/45; 175/61

(58) Field of Search ..... 175/24, 26, 27, 175/40, 45, 48, 50, 61

(56) References Cited

U.S. PATENT DOCUMENTS

| | | | | |
|---|---|---|---|---|
| 3,497,019 | | 2/1970 | Ortloff . | |
| 4,430,892 | | 2/1984 | Owings . | |
| 4,575,261 | | 3/1986 | Berger et al. . | |
| 4,662,458 | | 5/1987 | Ho . | |
| 4,695,957 | | 9/1987 | Peltier . | |
| 4,761,889 | * | 8/1988 | Cobern et al. | 33/302 |
| 4,794,534 | | 12/1988 | Millheim . | |
| 4,805,449 | * | 2/1989 | Das | 73/151 |
| 4,854,397 | | 8/1989 | Warren et al. . | |
| 4,903,245 | | 2/1990 | Close et al. . | |
| 4,956,921 | * | 9/1990 | Coles | 33/304 |
| 4,972,703 | | 11/1990 | Ho . | |
| 5,064,006 | * | 11/1991 | Waters et al. | 175/45 |

(List continued on next page.)

FOREIGN PATENT DOCUMENTS 2 247 477 4/1992 (GB) .

OTHER PUBLICATIONS

"Well–site analysis headed for economy, new capabilities," *The Oil and Gas Jnl.*, pp. 132, 134, 136 & 141 (Sep. 24, 1973).

Hutchinson et al., AN MWD "Downhole Assistant Driller," *Society of Petroleum Engineers*, pp. 743–752 (Oct. 1995).

Barr et al., "Steerable Rotary Drilling With An Experimental System," *Society of Petroleum Engineers*, pp. 435–450 (1995).

*Primary Examiner*—Hoang Dang
(74) *Attorney, Agent, or Firm*—Madan, Mossman & Sriram, P.C.

(57) ABSTRACT

The present invention provides a drilling system that utilizes an integrated bottom hole assembly. The bottom hole assembly contains sensors for determining the health of the bottom hole assembly, borehole condition, formation evaluation characteristics, drilling fluid physical and chemical properties, bed boundary conditions around and in front of the drill bit, seismic maps and the desired drilling parameters that include the weight on bit, drill bit speed and the fluid flow rate. A downhole processor controls the operation of the various devices in the bottom hole assembly to effect changes to the drilling parameters and the drilling direction to optimize the drilling effectiveness.

28 Claims, 16 Drawing Sheets

U.S. PATENT DOCUMENTS

| | | | | |
|---|---|---|---|---|
| 5,163,521 | | 11/1992 | Pustanyk et al. . | |
| 5,230,387 | | 7/1993 | Waters et al. . | |
| 5,250,806 | | 10/1993 | Rhein-Knudsen et al. . | |
| 5,269,383 | * | 12/1993 | Forrest | 175/26 |
| 5,318,137 | | 6/1994 | Johnson et al. . | |
| 5,332,048 | | 7/1994 | Underwood et al. . | |
| 5,341,886 | | 8/1994 | Patton . | |
| 5,353,873 | * | 10/1994 | Cooke, Jr. | 166/253 |
| 5,358,059 | | 10/1994 | Ho . | |
| 5,390,748 | | 2/1995 | Goldman . | |
| 5,394,951 | | 3/1995 | Pringle et al. . | |
| 5,410,303 | | 4/1995 | Comeau et al. . | |
| 5,419,505 | | 5/1995 | Patton . | |
| 5,439,064 | * | 8/1995 | Patton | 175/24 |
| 5,467,832 | * | 11/1995 | Orban et al. | 175/45 |
| 5,473,158 | * | 12/1995 | Holenka et al. | 250/254 |
| 5,490,569 | | 2/1996 | Brotherton et al. . | |
| 5,602,541 | | 2/1997 | Comeau et al. . | |
| 5,678,643 | * | 10/1997 | Robbins et al. | 175/45 |
| 5,803,185 | * | 9/1998 | Barr et al. | 175/45 |

* cited by examiner

DRILLING SYSTEM WITH INTEGRATED BOTTOM HOLE ASSEMBLY

CROSS-REFERENCE TO RELATED APPLICATION

This application takes the benefit of the filing date of U.S. patent application Ser. No. 60/051,614, filed on Jun. 27, 1997 and is a continuation-in-part of U.S. patent applications Ser. No. 08/371,879, filed on Jan. 12, 1995, Ser. No. 08/570,838, filed on Dec. 12, 1996 now U.S. Pat. No. 5,812,068, and Ser. No. 08/734,935, filed on Oct. 22, 1996, now U.S. Pat. No. 5,842,149.

BACKGROUND OF THE INVENTION

1. Field of the Invention

This invention relates generally to systems for drilling oilfield wellbores and more particularly to an integrated bottom hole assembly (BHA) for use in drilling wellbores. The BHA includes a drill bit and a variety of devices, sensor and interactive models. The BHA tests and calibrates sensors, and determines the operating condition of devices, formation parameters, wellbore condition, and the condition of the drilling fluid. The BHA utilizing such information and the models determines the desired operating parameters that will provide enhanced overall drilling performance and longer BHA operating life. The BHA takes actions to control the drilling operations based the computed parameters or upon command from the surface or a both and in accordance with a higher logic provided to the BHA, thereby improving the overall effectiveness of the drilling operations.

2. Description of the Related Art

Oilfield wellbores are formed by rotating a drill bit carried at an end of an assembly commonly referred to as the bottom hole assembly or "BHA." The BHA is conveyed into the wellbore by a drill pipe or coiled-tubing. The rotation of the drill bit is effected by rotating the drill pipe and/or by a mud motor depending upon the tubing used. For the purpose of this invention, BHA is used to mean the bottom hole assembly with or without the drill bit. Prior art bottom hole assemblies generally include one or more formation evaluation sensors, such as sensors for measuring the resistivity, porosity and density of the formation. Such bottom hole assemblies also include devices to determine the BHA inclination and azimuth, pressure sensors, temperature sensors, gamma ray devices, and devices that aid in orienting the drill bit a particular direction and to change the drilling direction. Acoustic and resistivity devices have been proposed for determining bed boundaries around and in some cases in front of the drill bit.

In practice, the bottom hole assemblies are manufactured for specific applications and each such version usually contains only a selected number of devices and sensors. Additionally, such BHA's have limited data processing capabilities and do not compute the parameters downhole that can be used to control the drilling operations. Instead, such bottom hole assemblies transmit data or partial answers uphole via a relatively small data-rate telemetry system. The drilling decisions are made at the surface based on the information provided by the BHA, data gathered during drilling of prior wellbores, and geophysical or seismic maps of the field. Drilling parameters, such as the weight-on-bit, drilling fluid flow rate, drill bit r.p.m. are usually measured and controlled at the surface. The prior art bottom hole assemblies do not provide a comprehensive or integrated approach to drilling wellbores as more fully explained below.

The operating or useful life of the drill bit, mud motor, bearing assembly, and other elements of the BHA depends upon the manner in which such devices are operated and the downhole conditions. This includes rock type, drilling conditions such as pressure, temperature, differential pressure across the mud motor, rotational speed, torque, vibration, drilling fluid flow rate, force on the drill bit or the weight-on-bit ("WOB"), type of the drilling fluid used and the condition of the radial and axial bearings.

Operators often tend to select the rotational speed of the drill bit and the WOB or the mechanical force on the drill bit that provides the greatest or near greatest rate of penetration ("ROP"), which over the long run may not be most cost effective method of drilling. Higher ROP can generally be obtained at higher WOB and higher rpm, which can reduce the operating life of the components of the BHA.

If any of the essential BHA component fails or becomes relatively ineffective, the drilling operation must be shut down to pull out the drill string from the borehole to replace or repair such a component. Typically, the mud motor operating life at the most effective power output is less than those of the drill bits. Thus, if the motor is operated at such a power point, the motor may fail prior to the drill bit This will require stopping the drilling operation to retrieve and repair or replace the motor. Such premature failures can significantly increase the drilling cost. It is, thus, highly desirable to monitor critical parameters relating to the various components of the BHA and determine therefrom the desired operating conditions that will provide the most effective drilling operations.

The drill bit speed can be selected by controlling the fluid flow through the mud motor or by controlling the rotary motor speed at the surface. The mud motor operating efficiency depends primarily upon the differential pressure across the mud motor. However, the mud motor, if operated at the optimum efficiency may provide higher rate of penetration, but the presence of unfavorable drilling conditions, such as high stator temperature, excessive vibration and WOB, etc. may significantly reduce the operating life of the mud motor. Similarly drilling at relatively high ROP through hard rocks may quickly wear out the drill bit. Relatively high ROP may also produce undesirable amounts of vibrations, whirl, stick-slip, axial and radial displacement of the BHA. Drilling at a lower drilling rate may result in significantly extending the life of the drill bit, mud motor, bearing assembly or other elements of the BHA, thereby reducing the number of retrieval trips to repair or replacement or repair of the BHA. A comprehensive strategy can result in drilling wellbores in less time and at less cost, because each BHA retrieval and repair trip can take several hours and can significantly increase the equipment cost. Prior art bottom hole assemblies fail to provide any comprehensive approach to the drilling.

Physical and chemical properties of the drilling fluid near the drill bit can be significantly different from those at the surface. Currently, such properties are usually measured at the surface, which are then used to estimate the properties downhole. Fluid properties, such as the viscosity, density, clarity, pH level, temperature and pressure profile can significantly affect the drilling efficiency. Downhole measured drilling fluid properties can provide useful information about the actual drilling conditions near the drill bit.

The present invention addresses the above noted problems and provides a an integrated BHA that utilizes interactive dynamic models to monitor physical parameters relating to various elements in the BHA (including drill bit wear, temperature, mud motor rpm, torque, differential pressure across the mud motor, stator temperature, bearing assembly temperature, radial and axial displacement, oil level in the case of sealed-bearing-type bearing assemblies, and WOB), determines the fluid properties downhole, determines the drilling parameters (force on the drill bit or WOB, fluid flow rate, and rpm) that will provide enhanced drilling rate and extended BHA life, i.e., greater drilling effectiveness and operates the various downhole controllable devices to achieve higher drilling effectiveness.

SUMMARY OF THE INVENTION

The present invention provides a closed-loop drilling system which utilizes an integrated bottom hole assembly ("BHA"). The BHA includes sensors which determine the physical parameters of the BHA components (such as drill bit wear, temperature, mud motor rpm, torque, differential pressure across the mud motor, stator temperature, bearing assembly temperature, radial and axial displacement, oil level in the case of sealed-bearing-type bearing assemblies, and WOB), fluid sensors to determine the fluid properties downhole (such as the fluid density, viscosity, rheology, clarity, cutting size and shape, pH level, oil/water/gas content, etc.), formation evaluation sensors, and sensors to determine the boundary conditions of the surrounding formation and the seismic maps. A processor in the BHA utilizes a plurality of interactive model to determine from the various downhole measurements and the data provided from the surface the operating health of the BHA, the drilling parameters that will provide greater drilling effectiveness and causes the downhole devices to adjust one or more of such parameters to achieve the greater drilling effectiveness.

The BHA also includes sensors for determining the borehole condition, such as the borehole size, roughness and cracks. One or more acoustic sensor arrangements are used to determine the boundary conditions around and in front of the drill bit. A downhole processor cooperates with a surface computer in the system to effect changes in the drilling parameters. Models provided to the drilling system enable determining dysfunctions relating to specific BHA components.

The system of the present invention achieves drilling at enhanced drilling rates and with extended BHA life. It also allows the operator and/or the system to simulate or predict the effect of changing the drilling parameters from their current levels on further drilling of the wellbore. The system can thus look ahead in the drilling process and determine the optimum course of action. The system may also be programmed to dynamically adjust any model or data base as a function of the measurements made during the drilling operations. The models and data are also modified based on data from the offset wells, other wells in the same field and the well being drilled, thereby incorporating the knowledge gained from such sources into the models for drilling future wellbores. The operation is continually or periodically repeated, thereby providing an automated closed-loop drilling system for drilling oilfield wellbores with enhanced drilling rates and with extended drilling assembly life.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiments, taken in conjunction with the accompanying drawings, in which like elements have been given like numerals and wherein.

DESCRIPTION OF THE PREFERRED EMBODIMENTS

Figure 1:
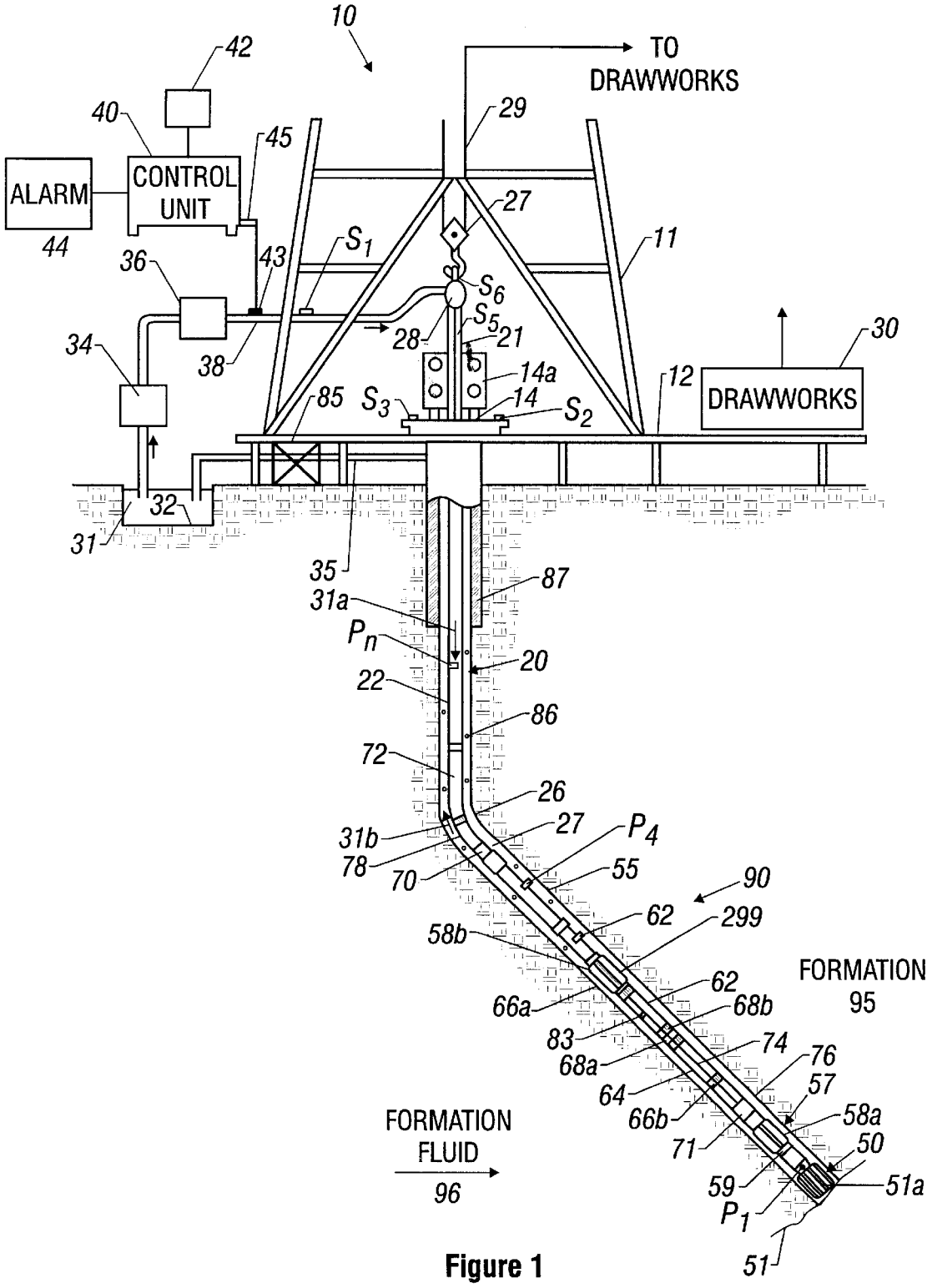
FIG. 1 is a schematic diagram of a drilling system with an integrated bottom hole assembly according to a preferred embodiment of the present invention.

In general, the present invention provides a drilling system for drilling oilfield boreholes or wellbores. An important feature of this invention is the use of an integrated bottom hole assembly ("BHA") (also referred to herein as the drilling assembly) for use in drilling wellbores. The BHA of the present invention includes a number of sensors, downhole controllable devices, processing circuits and a plurality of interactive dynamic models. The BHA carries the drill bit and is conveyed into the wellbore by a drill pipe or a coiled-tubing. The BHA utilizing the models and/or information provided from the surface processes sensor measurements, tests and calibrates the BHA components, computes parameters of interest that relate to the condition or health of the BHA components, computes formation parameters, borehole parameters, parameters relating to the drilling fluid, bed boundary information, and in response thereto determines the desired drilling parameters. The BHA preferably operates only those devices and sensors which are needed at any given time, which conserves downhole generated power and increases the operating life of the BHA components. It also takes actions downhole by automatically controlling or adjusting the downhole controllable devices to optimize the drilling effectiveness.

Specifically, the BHA includes sensors for determining parameters relating to the physical condition or health of the various components of the BHA, such as the drill bit wear, differential pressure across the mud motor, degradation of the mud motor stator, oil leaks in the bearing assembly, pressure and temperature profiles of the BHA and the drilling fluid, vibration, axial and radial displacement of the bearing assembly, whirl, torque and other physical parameters. Such parameters are generally referred to herein as the "BHA parameters" or "BHA health parameters." Formation evaluation sensors included in the BHA provide characteristics of the formations surrounding the BHA. Such parameters include the formation resistivity, dielectric constant, formation porosity, formation density, formation permeability, formation acoustic velocity, rock composition, lithological characteristics of the formation and other formation related parameters. Such parameters are generally referred to herein as the "formation evaluation parameters."

Sensors for determining the physical and chemical properties (referred to as the "fluid parameters") of the drilling fluid disposed in the BHA provide in-situ measurements of the drilling fluid parameters. The fluid parameters sensors include sensors for determining the temperature and pressure profiles of the wellbore fluid, sensors for determining the viscosity, compressibility, density, chemical composition (gas, water, oil and methane contents, etc.). The BHA also contains sensors which determine the position, inclination and direction of the drill bit (collectively referred to herein as the "position" or "directional" parameters); sensors for determining the borehole condition, such as the borehole size, roughness and cracks (collectively referred to as the "borehole parameters"); sensors for determining the locations of the bed boundaries around and ahead of the BHA; and sensors for determining other geophysical parameters (collectively referred to as the "geophysical parameters"). The BHA also measures "drilling parameters" or "operations parameters," which include the drilling fluid flow rate, drill bit rotary speed, torque, and weight-on-bit or the thrust force on the bit ("WOB").

The BHA contains steering devices that can be activated downhole to alter the drilling direction. The BHA also may contain a thruster for applying mechanical force to the drill bit for drilling horizontal wellbores and a jet intensifier for aiding the drill bit in cutting rocks. The BHA preferably includes redundant sensors and devices which are activated when their corresponding primary sensors or devices becomes inoperative.

Interactive models, some of which may be dynamic models, are stored in the BHA memory. A dynamic model is one that is updated during the drilling operations based on information obtained during such drilling operations. Such updated models are then utilized to further drill the borehole. The BHA contains a processor that processes the measurements from the various sensors, communicates with surface computers, and utilizing the interactive models determines which devices or sensors to operate at any given time. It also computes the optimum combination of the drilling parameters, the desired drilling path or direction, the remaining operating life of certain components of the BHA, the physical and chemical condition of the drilling fluid downhole, and the formation parameters. The downhole processor computes the required answers and, due to the limited telemetry capability, transmits to the surface only selected information. The information that is needed for later use is stored in the BHA memory. The BHA takes the actions that can be taken downhole. It alters the drilling direction by appropriately operating the direction control devices, adjusts fluid flow through the mud motor to operate it at the determined rotational speed and sends signals to the surface computer, which adjusts the drilling parameters. Additionally, the downhole processor and the surface computer cooperate with each other to manipulate the various types of data utilizing the interactive models, take actions to achieve in a closed-loop manner more effective drilling of the wellbore, and providing information that is useful for drilling other wellbores.

Dysfunctions relating to the BHA, the current operating parameters and other downhole-computed operating parameters are provided to the drilling operator, preferably in the form of a display on a screen. The system may be programmed to automatically adjust one or more of the drilling parameters to the desired or computed parameters for continued operations. The system may also be programmed so that the operator can override the automatic adjustments and manually adjust the drilling parameters within predefined limits for such parameters. For safety and other reasons, the system is preferably programmed to provide visual and/or audio alarms and/or to shut down the drilling operation if certain predefined conditions exist during the drilling operations. The preferred embodiments of the integrated BHA of the present invention and the operation of the drilling system utilizing such a BHA are described below.

FIG. 1 shows a schematic diagram of a drilling system 10 having a bottom hole assembly (BHA) or drilling assembly 90 shown conveyed in a borehole 26. The drilling system 10 includes a conventional derrick 11 erected on a floor 12 which supports a rotary table 14 that is rotated by a prime mover such as an electric motor (not shown) at a desired rotational speed. The drill string 20 includes a tubing (drill pipe or coiled-tubing) 22 extending downward from the surface into the borehole 26. A tubing injector 14*a* is used to inject the BHA into the wellbore when a coiled-tubing is used as the conveying member 22. A drill bit 50, attached to the drill string 20 end, disintegrates the geological formations when it is rotated to drill the borehole 26. The drill string 20 is coupled to a drawworks 30 via a kelly joint 21, swivel 28 and line 29 through a pulley 23. Drawworks 30 is operated to control the weight on bit ("WOB"), which is an important parameter that affects the rate of penetration ("ROP"). The operations of the drawworks 30 and the tubing injector are known in the art and are thus not described in detail herein.

During drilling, a suitable drilling fluid 31 from a mud pit (source) 32 is circulated under pressure through the drill string 20 by a mud pump 34. The drilling fluid passes from the mud pump 34 into the drill string 20 via a desurger 36 and the fluid line 38. The drilling fluid 31 discharges at the borehole bottom 51 through openings in the drill bit 50. The drilling fluid 31 circulates uphole through the annular space 27 between the drill string 20 and the borehole 26 and returns to the mud pit 32 via a return line 35 and drill cutting screen 85 that removes the drill cuttings 86 from the returning drilling fluid 31*b*. A sensor $S_1$ in line 38 provides information about the fluid flow rate. A surface torque sensor $S_2$ and a sensor $S_3$ associated with the drill string 20 respectively provide information about the torque and the rotational speed of the drill string 20. Tubing injection speed is determined from the sensor $S_5$, while the sensor $S_6$ provides the hook load of the drill string 20.

In some applications the drill bit 50 is rotated by only rotating the drill pipe 22. However, in many other applications, a downhole motor 55 (mud motor) is disposed in the drilling assembly 90 to rotate the drill bit 50 and the drill pipe 22 is rotated usually to supplement the rotational power, if required, and to effect changes in the drilling direction. In either case, the ROP for a given BHA largely depends upon the WOB or the thrust force on the drill bit 50 and its rotational speed.

The mud motor 55 is coupled to the drill bit 50 via a drive shaft (see 132 in FIG. 2A) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the mud motor 55 and the reactive upward loading from the applied weight on bit. A lower stabilizer 58*a* coupled to the bearing assembly 57 acts as a centralizer for the lowermost portion of the drill string 20.

A surface control unit or processor 40 receives signals from the downhole sensors and devices via a sensor 43 placed in the fluid line 38 and signals from sensors $S_1$–$S_6$ and other sensors used in the system 10 and processes such signals according to programmed instructions provided to the surface control unit 40. The surface control unit 40 displays desired drilling parameters and other information on a display/monitor 42 that is utilized by an operator to control the drilling operations. The surface control unit 40 contains a computer, memory for storing data, recorder for recording data and other peripherals. The surface control unit 40 also includes a simulation model and processes data according to programmed instructions. The control unit 40 is preferably adapted to activate alarms 44 when certain unsafe or undesirable operating conditions occur. The use of the simulation model is described later.

The BHA 90 preferably contains a downhole-dynamic-measurement device or "DDM" 59 that contains sensors which make measurements relating to the BHA parameters. Such parameters include bit bounce, stick-slip of the BHA, backward rotation, torque, shocks, BHA whirl, BHA buckling, borehole and annulus pressure anomalies and excessive acceleration or stress, and may include other parameters such as BHA and drill bit side forces, and drill motor and drill bit conditions and efficiencies. The DDM 59 sensor signals are processed to determine the relative value or severity of each such parameter as a parameter of interest, which are utilized by the BHA and/or the surface computer 40. The DDM sensors may be placed in a subassembly or placed individually at any suitable location in the BHA 90. Drill bit 50 may contains sensors 51*a* for determining the drill bit condition and wear.

The BHA also contains formation evaluation sensors or devices for determining resistivity, density and porosity of the formations surrounding the BHA. A gamma ray device for measuring the gamma ray intensity and other nuclear an non-nuclear devices used as measurement-while-drilling devices are suitably included in the BHA 90. As an example, FIG. 1 shows a resistivity measuring device 64 coupled above the lower kick-off subassembly 62. It provides signals from which resistivity of the formation near or in front of the drill bit 50 is determined. The resistivity device 64 has transmitting antennae 66*a* and 66*b* spaced from the receiving antennae 68*a* and 68*b*. In operation, the transmitted electromagnetic waves are perturbed as they propagate through the formation surrounding the resistivity device 64. The receiving antennae 68*a* and 68*b* detect the perturbed waves. Formation resistivity is derived from the phase and amplitude of the detected signals. The detected signals are processed by a downhole computer 70 to determine the resistivity and dielectric values.

An inclinometer 74 and a gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this invention. In addition, position sensors, such as accelerometers, magnetometers or a gyroscopic devices may be disposed in the BHA to determine the drill string azimuth, true coordinates and direction in the wellbore 26. Such devices are known in the art and therefore are not described in detail herein.

In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place. The above described resistivity device, gamma ray device and the inclinometer are preferably placed in a common housing that may be coupled to the motor. The devices for measuring formation porosity, permeability and density (collectively designated by numeral 78) are preferably placed above the mud motor 55. Such devices are known in the art and are thus not described in any detail.

As noted earlier, a large number of the current drilling systems, especially for drilling highly deviated and horizontal wellbores, utilize coiled-tubing for conveying the drilling assembly downhole. In such application a thruster 71 is deployed in the drill string 90 to provide the required force on the drill bit. For the purpose of this invention, the term weight on bit is used to denote the force on the bit applied to the drill bit during the drilling operation, whether applied by adjusting the weight of the drill string or by thrusters. Also, when coiled-tubing is utilized the tubing is not rotated by a rotary table, instead it is injected into the wellbore by a suitable injector 14*a* while the downhole motor 55 rotates the drill bit 50.

A number of sensors are also placed in the various individual devices in the drilling assembly. For example, a variety of sensors are placed in the mud motor power section, bearing assembly, drill shaft, tubing and drill bit to determine the condition of such elements during drilling and to determine the borehole parameters. The preferred manner of deploying certain sensors in drill string 90 will now be described.

Figure 2A:
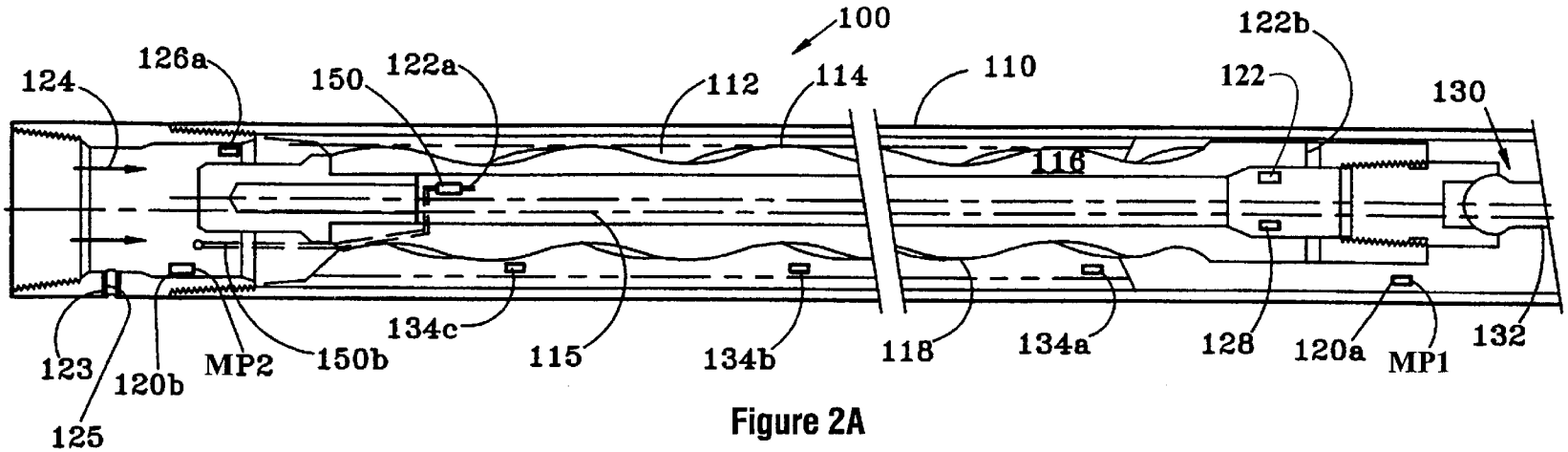
FIGS. 2A–2B show a longitudinal cross-section of a mud motor assembly that contains the power section and a non-sealed or mud-lubricated bearing assembly and a preferred manner of placing certain sensors for measuring mud motor parameters.
Figure 2B:
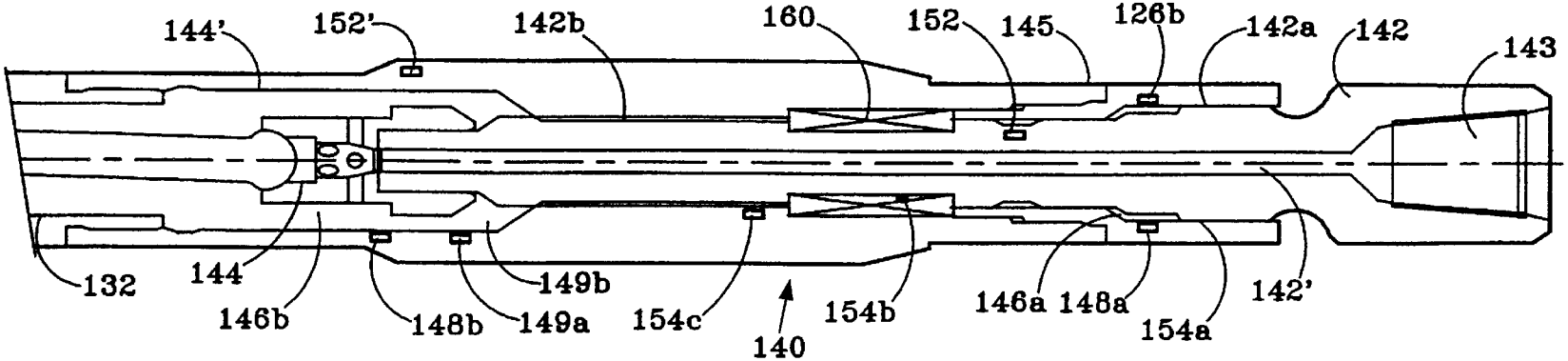

FIGS. 2A–2B show a cross-sectional elevation view of a positive displacement mud motor power section 100 coupled to a mud-lubricated bearing assembly 140 for use in the drilling system 10. The power section 100 contains an elongated housing 110 having therein a hollow elastomeric stator 112 which has a lobed inner surface 114. A metal rotor 116, preferably made from steel, having a lobed outer surface 118 is rotatably disposed inside the stator 112. The rotor 116 preferably has a non-through bore 115 that terminates at a point 122*a* below the upper end of the rotor as shown in FIG. 2*a*. The bore 115 remains in fluid communication with the fluid below the rotor via a port 122*b*. Both the rotor and stator lobe profiles are similar, with the rotor having one less lobe than the stator. The rotor and stator lobes and their helix angles are such that rotor and stator seal at discrete intervals resulting in the creation of axial fluid chambers or cavities which are filled by the pressurized drilling fluid.

The action of the pressurized circulating fluid flowing from the top to bottom of the motor, as shown by arrows 124, causes the rotor 116 to rotate within the stator 112. Modification of lobe numbers and geometry provides for variation of motor input and output characteristics to accommodate different drilling operations requirements.

Still referring to FIGS. 2A–2B, a differential pressure sensor 150 preferably disposed in line 115 senses at its one end pressure of the fluid 124 before it passes through the mud motor via a fluid line 150*a* and at its other end the pressure in the line 115, which is the same as the pressure of the drilling fluid after it has passed around the rotor 116. The differential pressure sensor thus provides signals representative of the pressure differential across the rotor 116. Alternatively, a pair of pressure sensors $MP_1$ and $MP_2$ may be disposed a fixed distance apart, one near the bottom of the rotor at a suitable point 120*a* and the other near the top of the rotor at a suitable point 120*b*. Another differential pressure sensor 122 (or a pair of pressure sensors) may be placed in an opening 123 made in the housing 110 to determine the pressure differential between the fluid 124 flowing through the motor 110 and the fluid flowing through the annulus 27 (see FIG. 1) between the drill string and the borehole.

To measure the rotational speed of the rotor and thus the drill bit 50, a suitable sensor 126*a* is coupled to the power section 100. A vibration sensor, magnetic sensor, Hall-effect sensor or any other suitable sensor may be utilized for determining the motor speed. Alternatively, a sensor 126*b* may be placed in the bearing assembly 140 for monitoring the rotational speed of the motor (see FIG. 2B). A sensor 128 for measuring the rotor torque is preferably placed at the rotor bottom. In addition, one or more temperature sensors may be suitably disposed in the power section 100 to continually monitor the temperature of the stator 112. High temperatures may result due to the presence of high friction of the moving parts. High stator temperature can deteriorate the elastomeric stator and thus reduce the operating life of the mud motor. In FIG. 2A three spaced temperature sensors 134*a–c* are shown disposed in the stator 112 for monitoring the stator temperature. Each of the above-described sensors generates signals representative of its corresponding mud motor parameter, which signals are transmitted to the downhole processor 70 by hard wire, magnetic or acoustic coupling. The processor processes such signals and transmits the processed signals uphole via the downhole telemetry 72.

The mud motor's rotary force is transferred to the bearing assembly 140 via a rotating shaft 132 coupled to the rotor 116. The shaft 132 disposed in a housing 130 eliminates all rotor eccentric motions and the effects of fixed or bent adjustable housings while transmitting torque and downthrust to the drive sub 142 of the bearing assembly 140. The type of the bearing assembly used depends upon the particular application. However, two types of bearing assemblies are most commonly used in the industry: a mud-lubricated bearing assembly such as the bearing assembly 140 shown in FIG. 2A, and a sealed bearing assembly, such as bearing assembly 170 shown in FIG. 2C.

Referring back to FIG. 2B, a mud-lubricated bearing assembly typically contains a rotating drive shaft 142 disposed within an outer housing 145. The drive shaft 142 terminates with a bit box 143 at the lower end that accommodates the drill bit 50 (see FIG. 1) and is coupled to the shaft 132 at the upper end 144 by a suitable joint 144'. The drilling fluid from the power section 100 flows to the bit box 143 via a through hole 142' in the drive shaft 142. The radial movement of the drive shaft 142 is restricted by a suitable lower radial bearing 142*a* placed at the interior of the housing 145 near its bottom end and an upper radial bearing 142*b* placed at the interior of the housing near its upper end. Narrow gaps or clearances 146*a* and 146*b* are respectively provided between the housing 145 and the vicinity of the lower radial bearing 142*a* and the upper radial bearing 142*b* and the interior of the housing 145.

During drilling operations, the radial bearings, such as shown in FIG. 2B, start to wear down causing the clearance to vary. Depending upon the design requirement, the radial bearing wear can cause the drive shaft to wobble, making it difficult for the drill string to remain on the desired course and in some cases can cause the various parts of the bearing assembly to become dislodged. Since the lower radial bearing 142*a* is near the drill bit, even a relatively small increase in the clearance at the lower end can reduce the drilling efficiency. To continually measure the clearance between the drive shaft 142 and the housing interior, displacement sensors 148*a* and 148*b* are respectively placed at suitable locations on the housing interior. The sensors are positioned to measure the movement of the drive shaft 142 relative to the inside of the housing 145. Signals from the displacement sensors 148*a* and 148*b* may be transmitted to the downhole control circuit by conductors placed along the housing interior (not shown) or by any other means described above in reference to FIG. 2A.

Still referring to FIG. 2B, a thrust bearing section 160 is provided between the upper and lower radial bearings to control the axial movement of the drive shaft 142. The thrust bearings 160 support the downthrust of the rotor 116, downthrust due to fluid pressure drop across the bearing assembly 140 and the reactive upward loading from the applied weight on bit. The drive shaft 142 transfers both the axial and torsional loading to the drill bit coupled to the bit box 143. If the clearance between the housing and the drive shaft has an inclining gap, such as shown by numeral 149*b*, then the same displacement sensor 149*a* may be used to determine both the radial and axial movements of the drive shaft 142. Alternatively, a displacement sensor may be placed at any other suitable place to measure the axial movement of the drive shaft 142. High precision displacement sensors suitable for use in borehole drilling are commercially available and, thus, their operation is not described in detail. From the discussion thus far, it should be obvious that weight on bit is an important control parameter for drilling boreholes. A load sensor 152, such as a strain gauge, is placed at a suitable place in the bearing assembly 140 (downstream of the thrust bearings 160) to continuously measure the weight on bit. Alternatively, a sensor 152' may be placed in the bearing assembly housing 145 (upstream of the thrust bearings 160) or in the stator housing 110 (see FIG. 2A) to monitor the weight on bit.

Figure 2C:
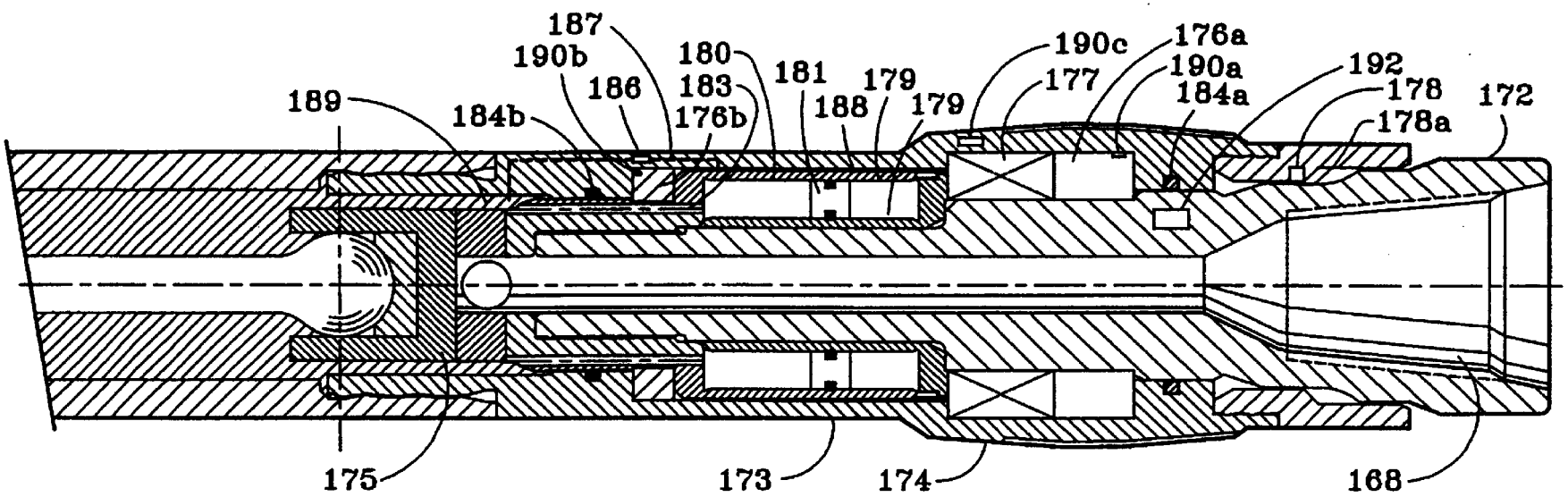
FIG. 2C shows a longitudinal cross-section of a sealed bearing assembly and a preferred manner of placing certain sensors therein for use with the power section of FIGS. 2A.

Sealed bearing assemblies are typically utilized for precision drilling and have much tighter tolerances compared to the mud-lubricated bearing assemblies. FIG. 2C shows a sealed bearing assembly 170, which contains a drive shaft 172 disposed in a housing 173. The drive shaft is coupled to the motor shaft via a suitable universal joint 175 at the upper end and has a bit box 168 at the bottom end for accommodating a drill bit. Lower and upper radial bearings 176*a* and 176*b* provide radial support to the drive shaft 172 while a thrust bearing 177 provides axial support. One or more suitably placed displacement sensors may be utilized to measure the radial and axial displacements of the drive shaft 172. For simplicity and not as a limitation, in FIG. 2C only one displacement sensor 178 is shown to measure the drive shaft radial displacement by measuring the amount of clearance 178*a*.

The radial and thrust bearings are continuously lubricated by a suitable working oil 179 placed in a cylinder 180. Lower and upper seals 184*a* and 184*b* prevent leakage of the oil during the drilling operations. However, due to the hostile downhole conditions and the wearing of various components, the oil frequently leaks, thus depleting the reservoir 180, thereby causing bearing failures. To monitor the oil level, a differential pressure sensor 186 is placed in a line 187 coupled between an oil line 188 and the drilling fluid 189 to provide the difference in the pressure between the oil pressure and the drilling fluid pressure. Since the differential pressure for a new bearing assembly is known, reduction in the differential pressure during the drilling operation may be used to determine the amount of the oil remaining in the reservoir 180. Additionally, temperature sensors 190*a–c* may be placed in the bearing assembly sub 170 to respectively determine the temperatures of the lower and upper radial bearings 176*a–b* and thrust bearings 177. Also, a pressure sensor 192 is preferably placed in the fluid line in the drive shaft 172 for determining the weight on bit. Signals from the differential pressure sensor 186, temperature sensors 190*a–c*, pressure sensor 192 and displacement sensor 178 are transmitted to the downhole control circuit in the manner described earlier in relation to FIG. 2A.

Figure 3A:
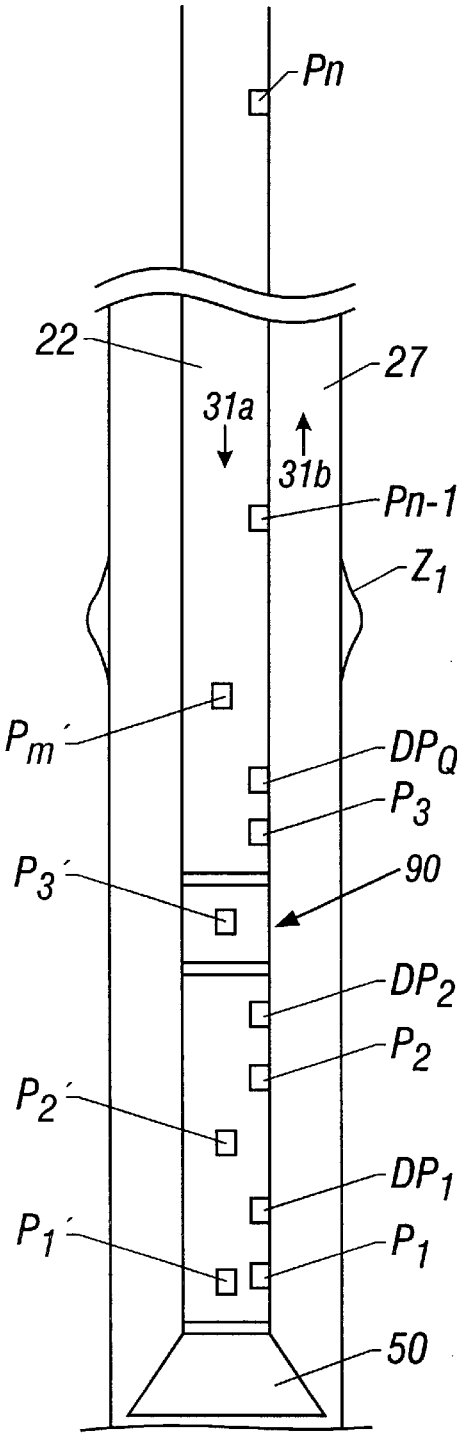
FIG. 3A shows a schematic diagram of a bottom hole assembly with a plurality of pressure sensors and differential pressure sensors according to the present invention.

The drilling system 10 includes sensors for determining physical and chemical properties of the drilling fluid and the temperature and pressure profiles along the drill string. Use of such sensors is described below. FIGS. 1 and 3A show the use of distributed pressure sensors for determining the pressure profile along the drill string 20 and the differential pressure sensors to determine pressure differential between selected locations in the drill string 20. A plurality of pressure sensors $P_1$–$P_n$, are disposed at selected location on the drill string 20 which provide the pressure of the fluid 31*b* in the annulus 27 at their respective locations. Pressure sensor $P_1$ is placed near the drill bit 50 to continuously monitor the pressure of the fluid leaving the drill bit 50. Another pressure sensor $P_n$ is disposed to determine the annulus pressure a short distance below the upper casing 87. Other pressure sensors $P_2$–$P_{n-1}$ are distributed at selected locations along the drill string 20. Also, pressure sensors $P_1'$–$P_m'$ are selectively placed within the drill string 20 to provide pressure measurements of the drilling fluid 31*a* flowing through the tubing 22 and the drilling assembly 90 at their respective locations. Additionally, differential pressure sensors $DP_1$–$DP_q$ disposed on the drill string 22 provide continuous measurements of the pressure difference between the fluid 31*b* in the annulus 27 and the fluid 31*a* in the drill string 20.

Control of the formation pressure is essential to the drilling. The hydrostatic pressure exerted by the fluid column is the primary method of controlling the pressure of the formation 95. Whenever the formation pressure exceeds the hydrostatic pressure exerted by the drilling fluid column, the formation fluids 96 enter the wellbore 26, causing a "kick." A kick is defined as any unscheduled entry of formation fluids into the wellbore. Early detection of kicks and prompt initiation of control procedures are keys to successful well control. If kicks are not detected early enough or controlled properly when detected, a blowout can occur. An essential element in detecting kicks is the pressure gradient. The distributed pressure sensor configuration shown in FIGS. 1 and 3A provide the pressure gradient along the drill string 20. Any sudden or step change in pressure between adjacent pressure sensors $P_1$–$P_n$ when correlated with other parameters, such as mud weights and geological information can provide an indication of the kick. Corrective action, such as changing the drilling fluid density, activating appropriate safety devices, and shutting down the drilling, if appropriate, are taken. Kick detection is transmitted by the downhole processor 70 to the surface.

Pressure sensors $P_1'$–$P_q'$ determine the pressure profile of the drilling fluid flowing inside the drill string. Comparison of annulus pressure and the pressure inside the drill sting provides useful information about pressure anomalies in the wellbore and an indication of the performance of the drilling motor 55. The differential pressure sensors $DP_1$–$DP_m$ provide continuous information about the difference in pressure of the drilling fluid in the drill string 22 and the annulus 27.

Figure 3B:
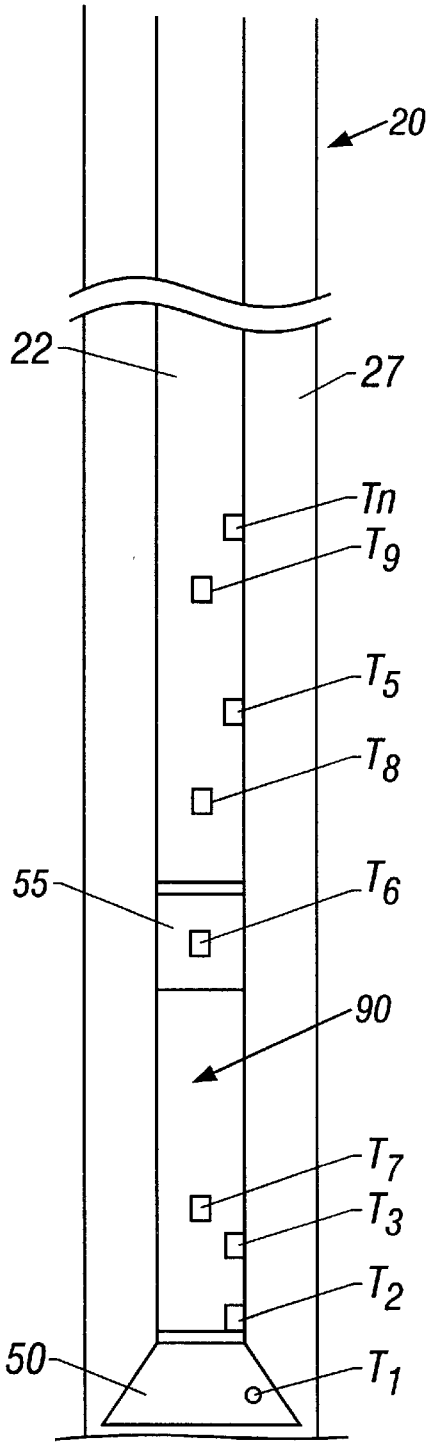
FIG. 3B shows a schematic diagram of a bottom hole assembly with a plurality of temperature sensors according to the present invention.

FIG. 1 and FIG. 3B show the placement of temperature sensors in one embodiment of the drill string 20. Referring to these figures, a plurality of temperature sensors $T_1$–$T_j$ are placed at selected location in the drill string. One or more temperature sensors $T_1$ are placed in the drill bit 50 to monitor the temperature of the drill bit and the drilling fluid near the drill bit. A temperature sensor $T_2$ placed within the drill string 20 above the drill bit 50 measures the temperature of the drilling fluid 31a entering the drill bit 50 The difference in temperature between $T_1$ and $T_2$ is an indication of the performance of the drill bit and the drilling fluid. Large temperature difference may be due to one or more of a lower fluid flow rate, drilling fluid composition, drill bit wear, weight on bit and drill bit rotational speed. The temperature difference is transmitted to the surface for the operator to take corrective action. The corrective action may include increasing the drilling fluid flow rate and if that does not alleviate this disfunction, to reduce the drilling speed. If this combination still does not result in reducing the temperature to a desired level, the mud composition or the drill bit may need to be changed. The rate of penetration (ROP) is also monitored, which is taken into effect prior to taking the above-described corrective actions.

Temperature sensors $T_2$–$T_5$ provide temperature profile or gradient of the fluid temperature in the annulus. The temperature gradient provides information regarding the effect of drilling and formations on the fluid temperature. The pressure gradient determined from the distributed sensors (see FIG. 2A) and the temperature gradient described with respect to FIG. 2B can be used to perform reservoir modeling during drilling of the wellbore. Reservoir modeling provides maps or information about the location and availability of hydrocarbons within a formation or field. Initial reservoir models are made from seismic data prior to drilling wellbores in a field, which are updated after the wellbore has been drilled and during production. Pressure and temperature measurement taken after drilling the wellbores are often used to update the reservoir models. The present invention enables updating the reservoir models during drilling of the wellbores due to the availability of the pressure and temperature gradients or profiles of the wellbore.

One or more temperature sensors $T_6$, placed in the drilling motor 55, determine the temperature of the drilling motor. Temperature sensors $T_7$–$T_9$ disposed within the drill string 20 provide temperature profile of the drilling fluid passing through the drilling assembly 90 and the mud motor 55. Predetermined temperature limits are preferably stored in the memory of the drilling assembly 90 and if such values are exceeded, the processor 70 alerts the operator or causes the surface control unit 40 to take predetermined actions, including shutting down the operation. The actual downhole pressure and temperature distributions are useful in determining the correct mud mix.

During drilling of wellbores, it is useful to determine physical properties of the drilling fluid. Such properties include density, viscosity, compressibility, clarity, solids content and rheology. Prior art methods usually employ testing and analysis of fluid samples taken from fluid returning to the surface. Such methods do not provide in-situ measurements and may not provide accurate measure of corresponding values downhole. The BHA 90 of the present invention includes devices and sensors which measure such parameters downhole during drilling of the wellbores.

Figure 3C:
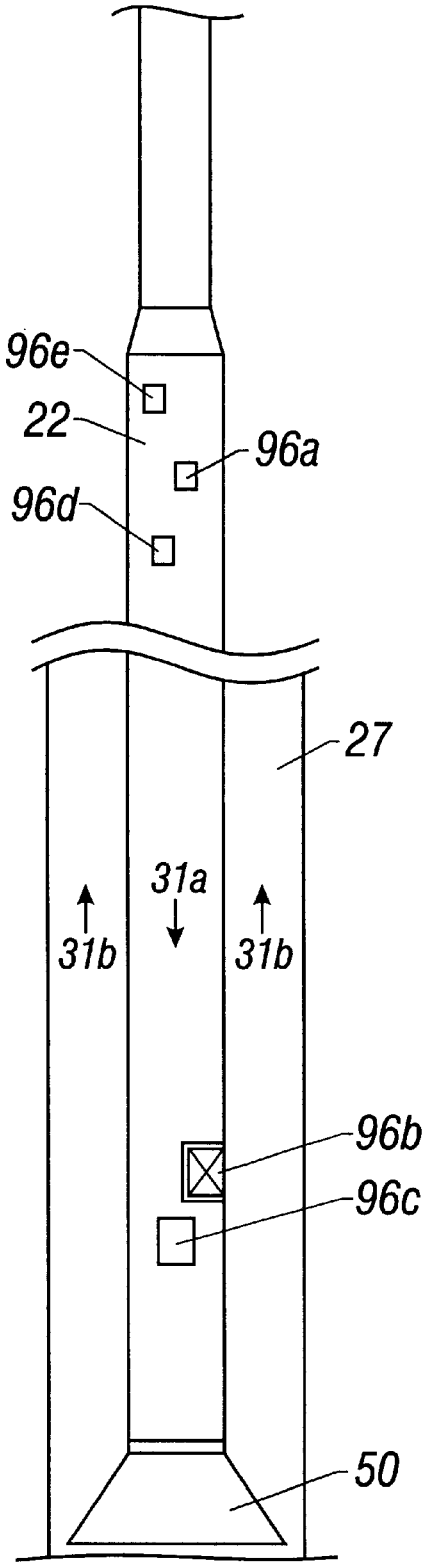
FIG. 3C shows a schematic diagram of a bottom hole assembly with a plurality of sensors for measuring chemical and physical properties of the drilling fluid.

Referring to FIGS. 1 and 3C, the BHA 90 includes a fluid density device 96*a* that determines the differential pressure of a drilling fluid column, which provides a direct measurement of the drilling fluid density. A sonic sensor or any other sensor also may be used to determine the fluid density. A plurality of spaced apart acoustic sensors provide the density profile of the drilling fluid in the annulus 27. Downhole measurements of the drilling fluid density provide accurate measure of the effectiveness of the drilling fluid. From the density measurements,among other things, it can be determined (a) whether cuttings are effectively being transported to the surface, (b) whether there is barite sag, i.e., barite is falling out of the drilling fluid, and (c) whether there is gas contamination or solids contamination. Downhole fluid density measurements provide substantially online information to the driller to take the necessary corrective actions, such as changing the fluid density, fluid flow, types of additives required, etc.

An ultrasonic sensor system 96*b* may be used to determine the borehole size and the amount of cuttings present in the annulus 27. The ultrasonic sensor 96*b* provides images of the borehole fluid which show the size, shape and the accumulation of the cuttings. Corrective action, such as increasing the flow rate, hole cleaning, and bit replacement can then be taken. By varying the frequency of transmission, depth of investigation can be varied to determine the borehole size and other boundary conditions.

A viscosity sensor or device 96*c* shown in FIG. 3C is used to determine the fluid viscosity downhole. Filtered fluid from the annulus 27 passes through a pair of moving plates, which measure the amount of friction. Viscosity is computed from the friction measurements by the downhole computer 70. Other devices, such as a rotating viscometer may be adapted for use in the drill string or an ultrasonic device may be utilized to determine the viscosity of a suitably collected sample in the BHA. Since direct measurements of the downhole pressure and temperature are available, the viscosity and density of the drilling fluid are calculated as a function of such parameters. Fluid compressibility is determined from a device 96*d*. A fluid sample is drawn into an air tight cylinder, which is then compressed by a suitable device, such as a piston. Reduction in the fluid volume provides a measure of the compressibility. Any other suitable device may be utilized for determining compressibility of the drilling fluid downhole.

Compressibility for water, oil, and gas (hydrocarbon) is different. For example computed downhole compressibility measurements can indicate whether gas or air is present. If it is determined that air is present, defoamers can be added to the drilling fluid 31 supplied to wellbore. Presence of gas may indicate kicks. Other gases that may be present are acidic gases such as carbon dioxide and hydrogen sulphide. The compressibility also affects performance of downhole motor 55.

Compressible fluid passing through the drilling motor 55 is less effective than non-compressible fluid. Maintaining the drilling fluid free from gas allows operating the mud motor at higher efficiency. Thus, altering compressibility can improve drilling rates.

Other sensors, generally denoted by numeral 96*d* are used to determine the pH level and the drilling fluid clarity downhole. Any commercially available device may be utilized for such purposes. Value of pH of the drilling fluid provides a measure of gas influx or water influx. Water influx can deteriorate the performance of oil based drilling fluids.

Various chemical properties of the drilling fluid are routinely measured at the surface from drilling fluid samples collected from the returning fluid. However, in many instances it is more desirable to determine certain chemical properties of the drilling fluid downhole during drilling operations, including the presence of gas (methane), hydrogen sulphide and oxygen.

The present invention utilizes specialized fiber optic sensors 96*e* to determine various chemical properties of the drilling fluid 31*b*. The sensor element is made of a porous glass having an additive specific to measuring the desired chemical property of the drilling fluid. Such porous glass material is referred to as sol-gel. The sol-gel method produces a highly porous glass. Desired additives are stirred into the glass during the sol-gel process. It is known that some chemicals have no color and, thus, do not lend themselves to analysis by standard optical techniques. But there are substances that will react with these colorless chemicals and produce a particular color, which can be detected by fiber optic sensor system. The sol-gel matrix is porous, and the size of the pores is determined by how the glass is prepared. The sol-gel process can be controlled to create a sol-gel indicator composite with pores small enough to trap an indicator in the matrix and large enough to allow ions of a particular chemical of interest to pass freely in and out and react with the indicator. Such a composite is called a sol-gel indicator. A sol-gel indicator can be coated on a probe which may be made from steel or other base materials suitable for downhole applications. Also, sol gel indicators have a relatively quick response time. The indicators are small and rugged and thus suitable for borehole applications. The sol-gel indicator may be calibrated at the surface and tends to remain calibrated. Compared to a sol-gel indicator, other types of measuring devices, such as a pH meter, requires frequent calibrations. Sol-gel indicators tend to be self-referencing. Therefore, reference and sample measurements may be taken utilizing the same probe. A spectroscopy device utilizing infra red or near infra red technique is utilized to detect the presence of certain chemicals, such as methane. The device contains a chamber which houses a fluid sample. Light passing through the fluid sample is detected and processed to determine the presence of the desired chemical.

In addition to the above-noted sensors, the drilling assembly 90 of the present invention also may include one or more sample collection and analysis device. Such a device is utilized to collect samples to be retrieved to the surface during tripping of the drill bit or for performing sample analysis during drilling. Also, in some cases it is desired to utilize a sensor in the drilling assembly for determining lubricity and transitivity of the drilling fluid. Drilling fluid resistivity may be determined from the above-noted resistivity device or by any other suitable device. Drilling fluid resistivity can provide information about the presence of hydrocarbons in water-based drilling fluids and of water in oil-based drilling fluids. Further, high pressure liquid chromatographer packaged for use in the drill string and any suitable calorimeter may also be disposed in the drill string to measure chemical properties of the drilling fluid.

Signals from the various above described sensors are processed downhole by the processor 70 to determine a value of the corresponding parameters of interest. The computed parameters are selectively transmitted to the surface control unit 40 via the telemetry 72. The surface control unit 40 displays the parameters on display 42. If any of the parameters are outside their respective limits, the surface control unit activates the alarm 44 and/or shuts down the operation as dictated by programmed instructions provided to the surface control unit 40. The present invention provides in-situ measurements of a number of properties of the drilling fluid that are not usually computed downhole during the drilling operation. Such measurements are utilized substantially online to alter the properties of the drilling fluid and to take other corrective actions to perform drilling at enhanced rates of penetration and extended drilling tool life.

The bottom hole assembly 90 also contains devices which may be activated downhole as a function of the downhole computed parameters of interest alone or in combination with surface transmitted signals to adjust the drilling direction without retrieving the drill string from the borehole, as is commonly done in the prior art. This is achieved in the present invention by utilizing downhole adjustable devices, such as the stabilizers and kick-off assembly described below.

Figure 4:
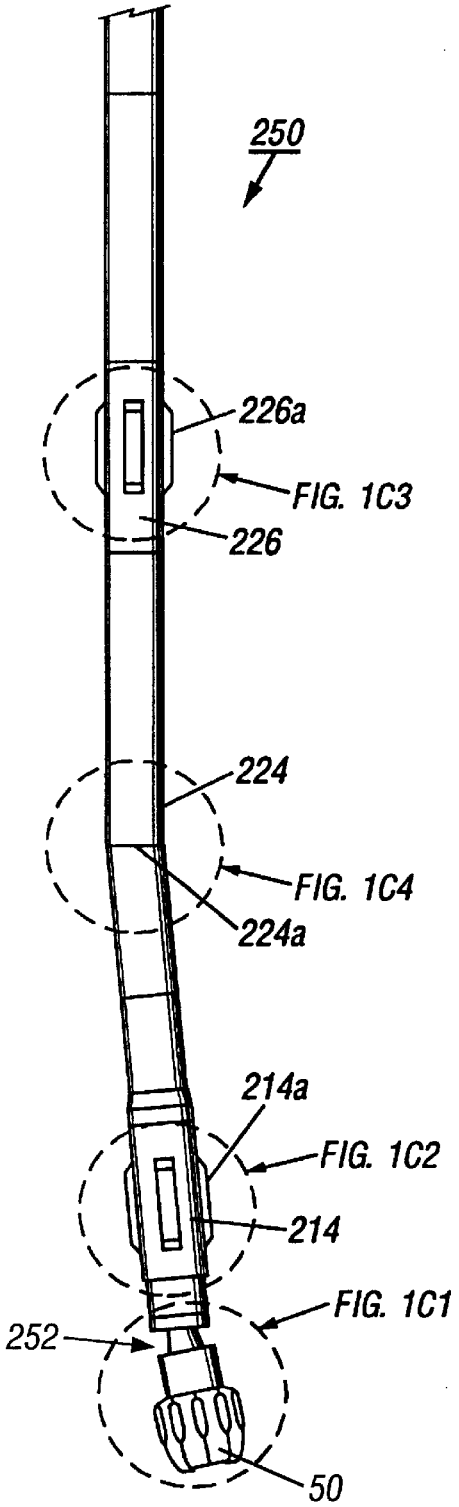
FIG. 4 shows a schematic diagram of an embodiment of certain steering or deflection devices placed in relation to each other in a downhole assembly.
Figure 4C:
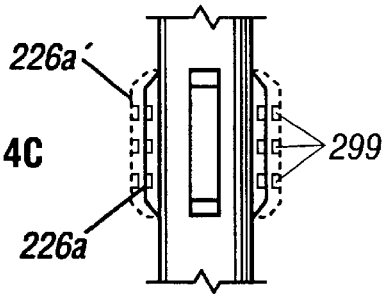
FIGS. 4A–4D show the operation of the deflection devices of FIG. 4.
Figure 4D:
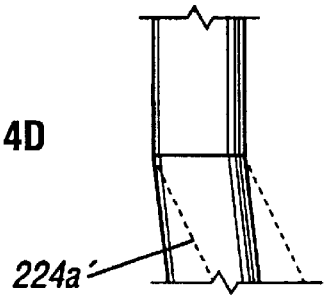
Figure 4B:
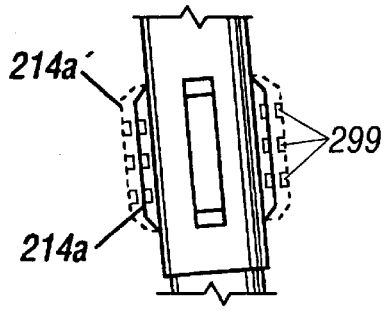
Figure 4A:
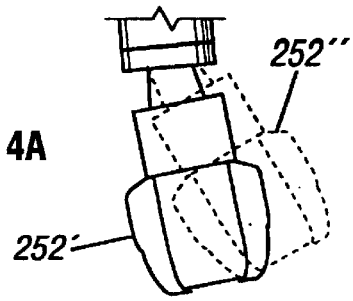

Referring to FIG. 4, the deflection device arrangement 250 contains an adjustable bit subassembly 252 that is coupled directly to the drill bit 50. The drill bit subassembly 252 has an associated control mechanism which upon receiving appropriate command signals causes the drill bit 50 to turn from a current position 252' to a desired position 252" as shown in the exploded view of FIG. 4A. Typically, the drill bit subassembly 250 can effect relatively small changes in the drilling course.

To effect greater drill bit directional changes or steering while drilling, the downhole assembly is provided with downhole adjustable lower and upper stabilizers 214 and 226 and an adjustable kick-off subassembly 224. The lower and upper stabilizers 214 and 226 have a plurality of associated independently adjustable pads 214*a* and 226*a* as shown in the exploded views of FIGS. 4B, and 4C. Each adjustable pad is adapted to be radially extended and contracted to any desired position by a hydraulically or electrically-operated device within the downhole subassembly 90. Alternatively, the stabilizer pads may be made to move in unison and extended or contracted to desired positions. The kick-off subassembly 224 is designed so that it may be turned at a deflection point 224*a* to a desired angle, as shown by the dotted lines 224*a*' in the exploded view of FIG. 4D. The adjustable pads 214*a* and 226*a* and the kick-off subassembly 224 are responsive to selected downhole signals executed by a downhole computer 70 and/or signals transmitted from a surface computer 40. The lower adjustable pads 214*a*, upper adjustable pads 226*a* and kick-off subassembly 224 define a three point geometry, which enables steering the drill bit 50 in any desired direction. An alternative rib steering device is shown in the drilling assembly of FIG. 5.

Figure 5:
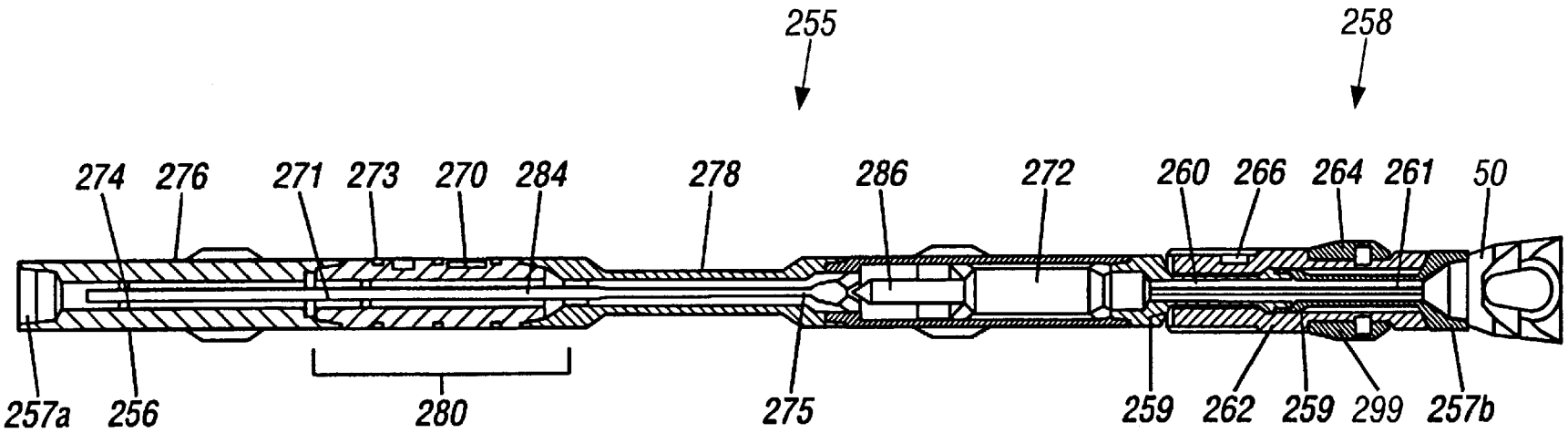
FIG. 5 shows a schematic diagram of a drilling assembly for use with a surface rotary system for drilling boreholes, wherein the drilling assembly has a non-rotating collar for effecting directional changes downhole.

FIG. 5 shows a schematic diagram of a rotary drilling assembly 255 conveyable downhole by a drill pipe (not shown) that includes a device for changing drilling direction without stopping the drilling operations for use in the drilling system 10 shown in FIG. 1. The drilling assembly 255 has an outer housing 256 with an upper joint 257*a* for connection to the drill pipe (not shown) and a lower joint 257*b* for accommodating a drill bit 50. During drilling operations the housing, and thus the drill bit 50, rotate when the drill pipe is rotated by the rotary table at the surface. The lower end 258 of the housing 256 has reduced outer dimensions 258 and a bore 259 therethrough. The reduced-dimensioned end 258 has a shaft 260 that is connected to the lower end 257*b* and a passage 261 for allowing the drilling fluid to pass to the drill bit 50. A non-rotating sleeve 262 is disposed on the outside of the reduced dimensioned end 258, in that when the housing 256 is rotated to rotate the drill bit 50, the non-rotating sleeve 262 remains in its position. A plurality of independently adjustable or expandable ribs 264 are disposed on the outside of the non-rotating sleeve 262. Each rib 264 is preferably hydraulically operated by a control unit in the drilling assembly 255. By selectively extending or retracting the individual ribs 264 during the drilling operations, the drilling direction can be substantially continuously and relatively accurately controlled. An inclination device 266, such as one or more magnetometers and gyroscopes, are preferably disposed on the non-rotating sleeve 262 for determining the inclination of the sleeve 262. A gamma ray device 270 and any other device may be utilized to determine the drill bit position during drilling, preferably the x, y, and z axis of the drill bit 50. An alternator and oil pump 272 are preferably disposed uphole of the sleeve 262 for providing hydraulic power and electrical power to the various downhole components, including the ribs 264. Batteries 274 for storing and providing electric power downhole are disposed at one or more suitable places in the drilling assembly 255.

The drilling assembly 255, like the drilling assembly 90 shown in FIG. 1, may include any number of devices and sensors to perform other functions and provide the required data about the various types of parameters relating to the drilling system described herein. The drilling assembly 255 preferably includes a resistivity device for determining the resistivity of the formations surrounding the drilling assembly, other formation evaluation devices, such as porosity and density devices (not shown), a directional sensor 271 near the upper end 257*a* and sensors for determining the temperature, pressure, fluid flow rate, weight on bit, rotational speed of the drill bit, radial and axial vibrations, shock, and whirl. The drilling assembly may also include position sensors for determining the drill string position relative to the borehole walls. Such sensors may be selected from a group comprising acoustic stand off sensors, calipers, electromagnetic, and nuclear sensors.

The drilling assembly 255 preferably includes a number of non-magnetic stabilizers 276 near the upper end 257*a* for providing lateral or radial stability to the drill string during drilling operations. A flexible joint 278 is disposed between the section 280 containing the various above-noted formation evaluation devices and the non-rotating sleeve 262. The drilling assembly 256 which includes a processor (same as processor 70 of FIG. 1), processes the signals and data from the various downhole sensors. Typically, the formation evaluation devices include dedicated electronics and processors as the data processing need during the drilling can be relatively extensive for each such device. Other desired electronic circuits are also included in the section 280. A telemetry device, in the form of an electromagnetic device, an acoustic device, a mud-pulse device or any other suitable device, generally designated herein by numeral 286 is disposed in the drilling assembly 255 at a suitable place.

Referring to FIGS. 1, 4 and 5, the extendable pads such as pads 214 (FIG. 4) and the ribs 264 (FIG. 5) are used for mounting certain sensors in the BHA 90. Such sensors are denoted by numeral 299. A relatively high frequency sensor is used to determine the resistivity and dielectric constant of the formation near the borehole 26 is wall. An acoustic sensor arrangement may be used to determine the acoustic velocity, porosity and permeability of the formation. Any other sensor may also be mounted in the pads or the ribs. Typically, non-steering ribs and pads are provided for mounting the sensors 299. During operations, the sensors 299 are urged against the inside during the duration when the corresponding measurements are desired.

Figure 6:
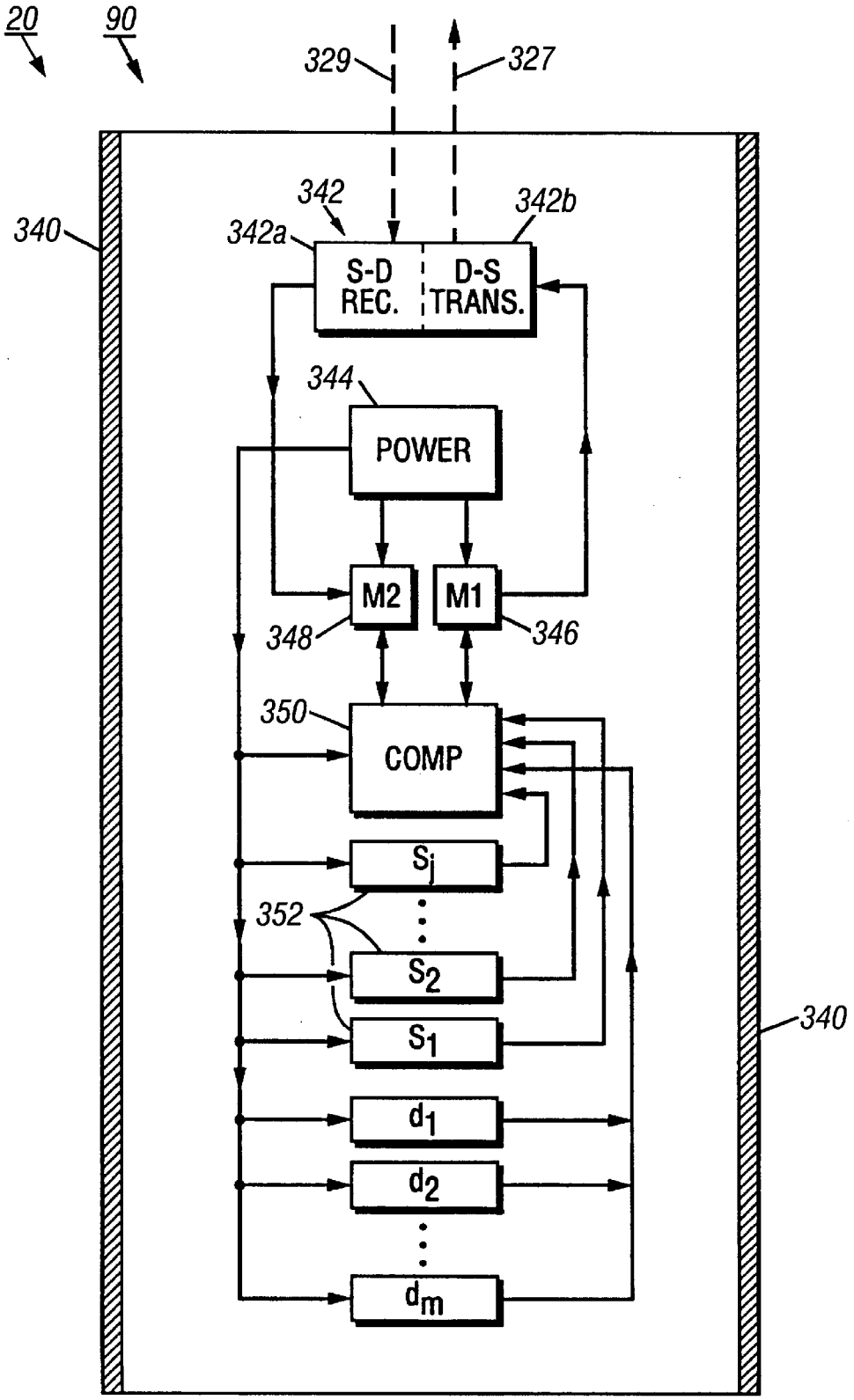
FIG. 6 shows a functional block diagram of the major downhole elements of the bottomhole assembly of the present invention.

FIG. 6 shows a functional block diagram of the major elements of the bottom hole assembly 90 and further illustrates with arrows the paths of cooperation between such elements. It should be understood that FIG. 6 illustrates only one arrangement of the elements and one system for cooperation between such elements. Other equally effective arrangements may be utilized to practice the invention. A predetermined number of discrete data point outputs from the sensors 352 ($S_1S_j$) are stored within a buffer which, in FIG. 6, is included as a partitioned portion of the memory capacity of a computer 350. The computer 350 preferably comprises commercially available solid state devices which are applicable to the borehole environment. Alternatively, the buffer storage means can comprise a separate memory element (not shown). The interactive models are stored within memory 348. In addition, other reference data such as seismic data, offset well log data statistics computed therefrom, and predetermined drilling path also are stored in the memory 348. A two way communication link exists between the memory 348 and the computer 350. The responses from sensors 352 are transmitted to the computer 350 wherein they are transformed into parameters of interest using methods which will be detailed in a subsequent section hereof.

The computer 350 also is operatively coupled to certain downhole controllable devices d1–dm, such as a thruster, adjustable stabilizers and kick-off subassembly for geosteering and to a flow control device for controlling the fluid flow through the drill motor for controlling the drill bit rotational speed.

The sensors 352 usually do not provide measurement corresponding to the same borehole location at the same time. Therefore, before combining the sensor data, the computer 350 shifts the raw sensor data to a common reference point, i.e. depth correlates such data, preferably by utilizing depth measurements made by the downhole depth measurement device contained in the downhole subassembly 90. Also, different sensors 352 usually do not exhibit the same vertical resolution. The computer 350, therefore, is programmed to perform vertical resolution matching before combining the sensor data. Any suitable method known in the art can be used to depth shift and resolution match the raw sensor data. Once computed from the depth shifted and resolution matched raw data, the parameters of interest are then passed to the down hole portion of the telemetry system 342 and subsequently telemetered to the surface by a suitable uplink telemetry means illustrated conceptually by the broken line 327. The power sources 344 supply power to the telemetry element 342, the computer 350, the memory modules 346 and 348 and associated control circuits (not shown), and the sensors 352 and associated control circuits (not shown). Information from the surface is transmitted over the downlink telemetry path illustrated by the broken line 329 to the downhole receiving element of downhole telemetry unit 342, and then transmitted to the storage device 48.

Figure 7:
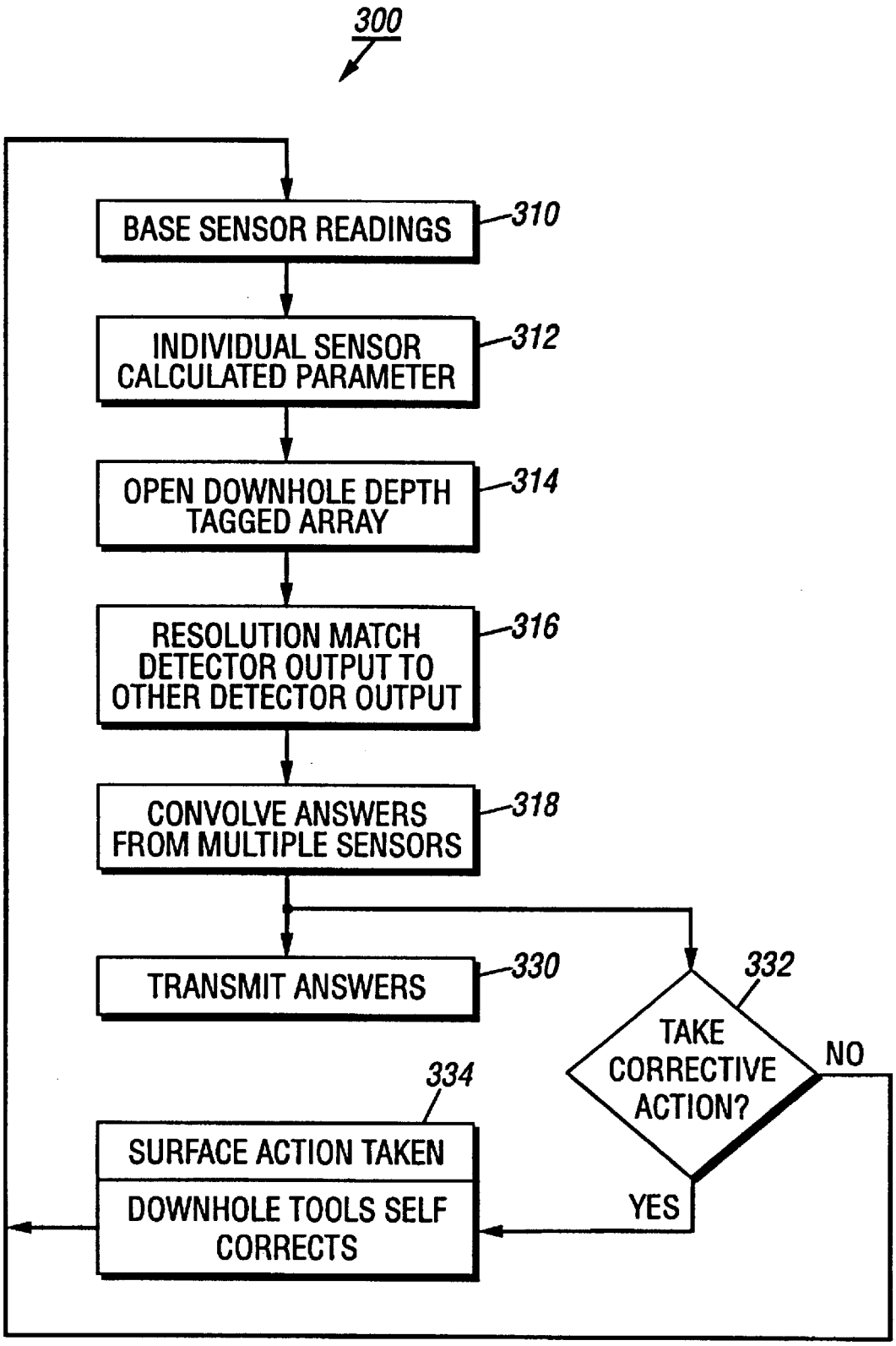
FIG. 7 shows a flow diagram showing the determination of the answers downhole utilizing the processors of the bottom hole assembly of the present invention.

FIG. 7 shows a generalized flow chart of determining parameters of interest downhole and the utilization of such parameters in the context of this invention. The individual sensors, such as the porosity, density, resistivity and gamma ray devices obtain base sensor measurement and calculate their respective parameters. For example the neutron porosity device may provide the value of the formation nuclear porosity ($\emptyset_n$) and the density device may provide the formation density. Such sensor measurements are retrieved by the computer 350 according to programmed instruction for determining the parameters of interest. The computer receives depth measurements from the downhole depth device 91 (FIG. 1) and/or from the surface processor 40 (FIG. 1) and correlates the sensor measurements to their respective true borehole depth as shown by the box 314. The downhole computer then matches the resolution of the depth correlated measurements. For example, neutron porosity on a sandstone matrix at a given depth resolution is matched to other sensor measurements in the downhole assembly.

The computer 350 then transforms or convolves a selected number of measurements to determine desired parameters of interest or answers as shown y the block 318. The parameters of interest may include parameters such as the water saturation ($S_w$), true formation porosity obtained from the neutron porosity $\emptyset_n$ and the formation density from the density device, flushed zone saturation, volume of shale in the formation ($V_{sh}$), recovery factor index ("RFI"), amount of the drill string direction deviation from a desired borehole path, etc. The computer also may be adapted to compare the borehole formation logs with prior well logs and seismic data stored in downhole memory and to cause the deflection elements (see FIG. 4) to adjust the drilling direction. The computer 350 transmits selected answers to the surface 330 and takes certain corrective actions 332, such as correcting the drilling direction and adjusting the drill bit rotational speed by adjusting the fluid flow through the mud motor 55. The surface processor 40 receives the data from the downhole computer via the downhole telemetry and may send signals downhole to alter the downhole stored models and information, causing the downhole computer to take certain actions as generally shown by block 334. In one embodiment, the system described here is a closed loop system, in that the answers computed downhole may be adapted to cooperate with surface signals and may be utilized alone or in conjunction with external information to take certain action downhole during the drilling operations. The computed answers and other information are preferably stored downhole for later retrieval and further processing. Some of the advantages of the above-described method are listed below.

(1) A plurality of formation-evaluation sensors can be used since data processing is performed downhole and the use of limited MWD telemetry and storage is optimized. Parallel, rather than serial, processing of data from multiple types of sensors can be employed. Serial processing is common in both current MWD and wireline systems. As a simple example, formation porosities computed from acoustic travel time, neutron porosity and bulk density measurements are currently processed serially in that environmental corrections such as borehole size effects are first made to each measurement and the environmentally corrected determinations are then combined to obtain previously discussed formation lithology and improved formation porosity measurements. The current invention allows the correction of all sensor measurements in parallel for environmental effects and computes the desired formation parameters simultaneously since the response matrix of the sensor combination is used rather than three individual response relationships for the acoustic, neutron porosity and bulk density measurements, with subsequent combination of parameters individually corrected for environmental effects. This reduces propagation of error associated with environmental corrections resulting in a more accurate and precise determination of parameters of interest. Parallel processing is possible only through the use of downhole computation because of data transmission and storage limitations.

(2) Only computed formation parameters of interest, rather than the raw sensor data, are telemetered or stored. As a result, telemetry and storage capacity is also available for the determination of additional, non-formation type, yet critically important parameters, such as drilling dynamics and the operational status or "health" of all downhole measuring systems. This reduces drilling costs and insures that measured data and resulting computations are valid.

(3) Since downhole computation reduces the volume of data that must be telemetered to the surface and since the telemetered data are parameters of interest, real-time decisions can be made based upon these measurements. As an example, in the drilling of horizontal boreholes within a selected formation, real-time formation parameters are transmitted to the surface. If these parameters indicate that the drill bit is approaching the boundary of the selected formation or has passed out of the selected formation, the logs indicate this excursion in real time so that the driller can take remedial steps to return the bit to the selected formation. This is referred to as "geosteering" in the industry and, again, is optimized by the current invention in that downhole computation and subsequent telemetering of only selected parameters of interest does not exceed available band width.

(4) The quality of combination-type formation evaluation parameters which can be determined with the current invention are comparable to wireline measurements and thereby eliminate partially or completely the need to run wireline logs at the completion of the drilling operation. This results in a substantial cost savings in either the completion or abandonment of the well.

As noted above, the present invention utilizes dynamic interactive models. One such model determines the severity of the dysfunctions of the BHA 90 and computes the desired drilling parameters that will alleviate the dysfunction and provide more effective drilling. This model may also be utilized to simulate the effect of changing the drilling parameters on the further drilling of the wellbore.

Figure 8A:
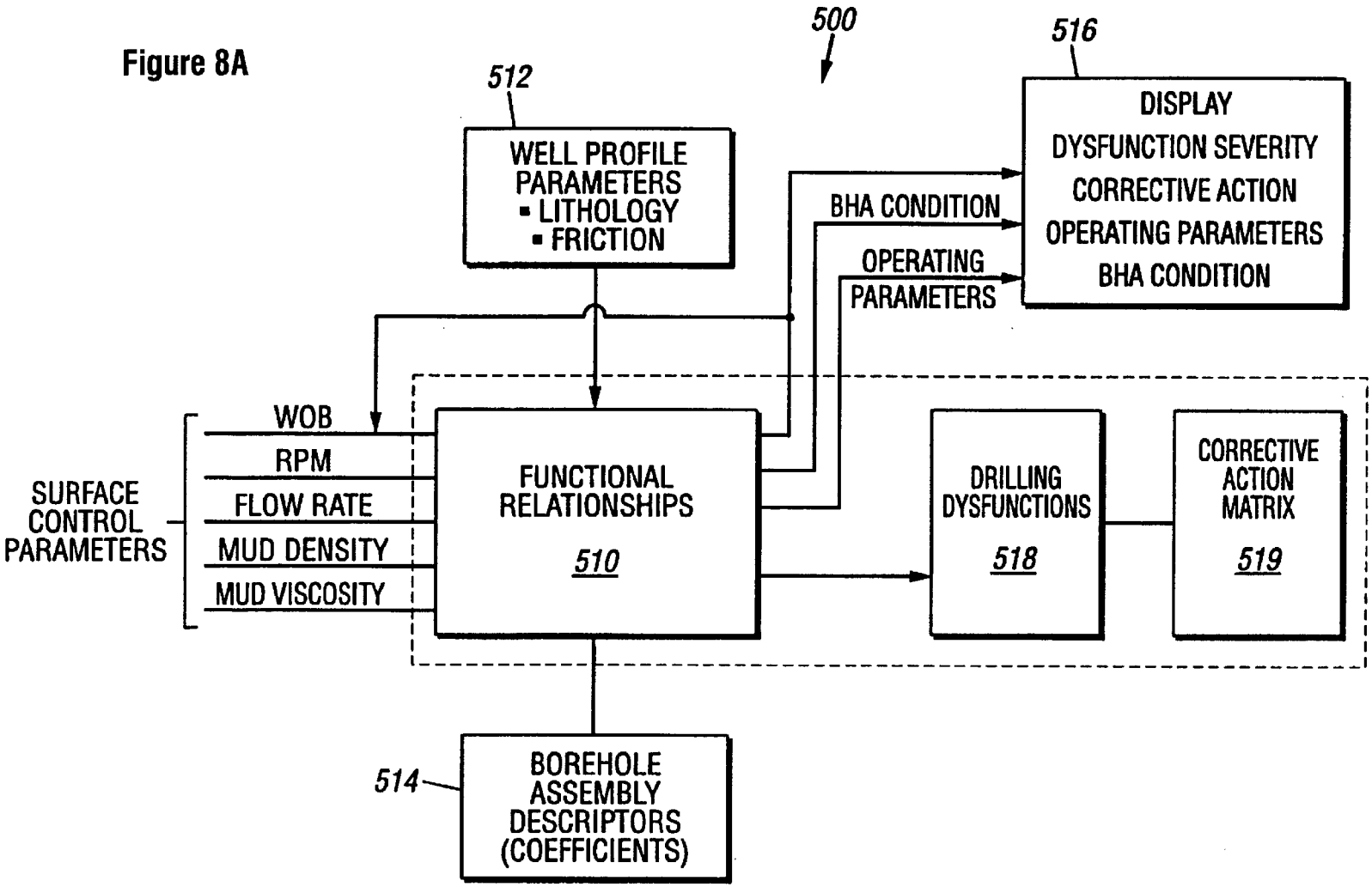
FIG. 8A shows a functional block diagram of an embodiment of a model for determining the effect of drilling parameters on the drilling effectiveness.

FIG. 8A show a functional block diagram of the preferred model 500 for use to simulate the downhole drilling conditions, display the severity of the drilling dysfunctions, and to determine which surface-controlled parameters should be changed to alleviate the dysfunctions. Block 510 contains predefined functional relationships for various parameters used by the model for simulating the downhole drilling operations. The well profile parameters 512 that define drillability factors through various formations are predefined and stored in the model. The well profile parameters 512 include a drillability factor or a relative weight for each formation type. Each formation type is given an identification number and a corresponding drillability factor. The drillability factor is further defined as a function of the borehole depth. The well profile parameters 512 also include a friction factor as a function of the borehole depth, which is further influenced by the borehole inclination and the BHA geometry. Thus, as the drilling progresses through the formation, the model continually accounts for any changes due to the change in the formation and change in the borehole inclination. Since the drilling operation is influenced by the BHA design, the model 500 is provided with a factor for the BHA used for performing the drilling operation. The BHA descriptors 514 are a function of the BHA design which take into account the BHA configuration (weight and length, etc.). The BHA descriptors 514 are defined in terms of coefficients associated with each BHA type, which are described in more detail later.

The drilling operations are performed by controlling the WOB, rotational speed of the drill string, the drilling fluid flow rate, fluid density and fluid viscosity so as to optimize the drilling rate. These parameters are changed as the drilling conditions change so as to optimize the drilling operations. Typically, the operator attempts to obtain the greatest drilling rate or the rate of penetration or "ROP" with consideration to minimizing drill bit and BHA damage. For any combination of these surface-controlled parameters, and a given type of BHA, the model 500 determines the value of selected downhole drilling parameters and the condition of BHA. The downhole determined BHA parameters include the bending moment, bit bounce, stick-slip of the drill bit, torque shocks, BHA whirl and lateral vibration. The model may be designed to determine any number of other parameters, such as the drag and differential pressure across the drill motor. The model also determines the condition of the BHA, which includes the condition of the MWD devices, mud motor and the drill bit. The output from the box 510 is the relative level or the severity of each computed downhole drilling parameter, the expected ROP and the BHA condition. The severity of the downhole computed parameter is displayed on a display 516, such as a monitor. The severity of the computed parameters determine dysfunctions.

The model 500 preferably utilizes a predefined matrix 519 to determine a corrective action, i.e., the surface-controlled parameters that should be changed to alleviate the dysfunctions. The determined corrective action, ROP, and BHA condition are displayed on the display 516. The model continually updates the various inputs and functions as the surface-controlled drilling parameters and the wellbore profile are changed and recomputes the drilling parameters and the other conditions as described above.

Figure 8B:
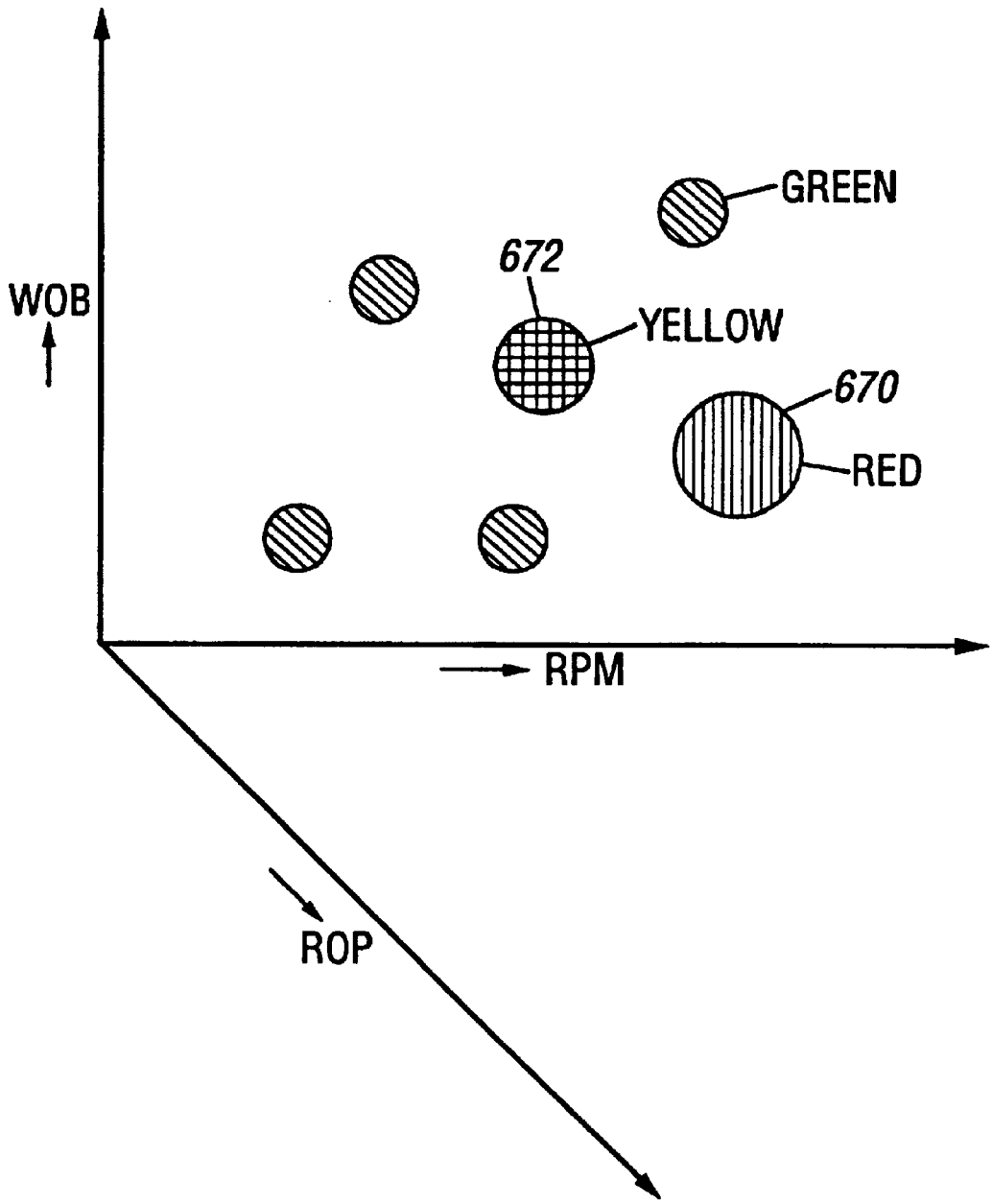
FIG. 8B shows a three dimensional graphical representation of the overall behavior of the drilling operation that may be utilized to optimize drilling operations.

FIG. 8*b* shows an example of a format to display the BHA performance. The performance is displayed in different colors: color green to indicate that the corresponding parameter is within a desired range; color yellow to indicate that the dysfunction is present but is not severe, much like a warning signal; and color red to indicate that the dysfunction is severe and should be corrected. As noted earlier, any other suitable display format may be devised for use in the present invention. The size of the circle indicates the range corresponding to the combination of the parameter values. Large green circles, therefore, will denote greater safe operating ranges.

Although the general objective of the operator in drilling wellbores is to achieve the highest ROP, such criterion, however, may not produce optimum drilling. For example, it is possible to drill a wellbore more quickly by drilling at an ROP below the maximum ROP but which enables the operator to drill for longer time periods before the drill string must be retrieved for repairs. The system of the present invention displays a three dimensional color view showing the extent of the drilling dysfunctions as a function of the drilling parameters.

The BHA computer 70 and/or the surface computer 40 can simulate the effect of changing the drilling parameters, for example to drill the next several hundred feet of the wellbore 26. Such simulation can be done to predict the drilling effectiveness and the rate of penetration. The results of the simulation are displayed in a suitable format. This helps in planning the drilling course for the remainder of the wellbore.

In summary, the system 10 by utilizing the model 500 quantifies the severity of each dysfunction, ranks or prioritizes the dysfunctions, and transmits the dysfunctions to the surface. The severity level of each dysfunction is displayed for the driller and/or at a remote location, such as a cabin at the drill site. The system provides substantially online suggested course of action, i.e., the values of the drilling parameters (such as WOB, RPM and fluid flow rate) that will eliminate the dysfunctions and improve the drilling efficiency. The operator at the drill rig or the remote location may simulate the operating condition, i.e., look ahead in time, and determine the optimum course of action with respect to values of the drilling parameters to be utilized for continued drilling of the wellbore. The models and data base utilized may be continually updated during drilling.

Figure 9:
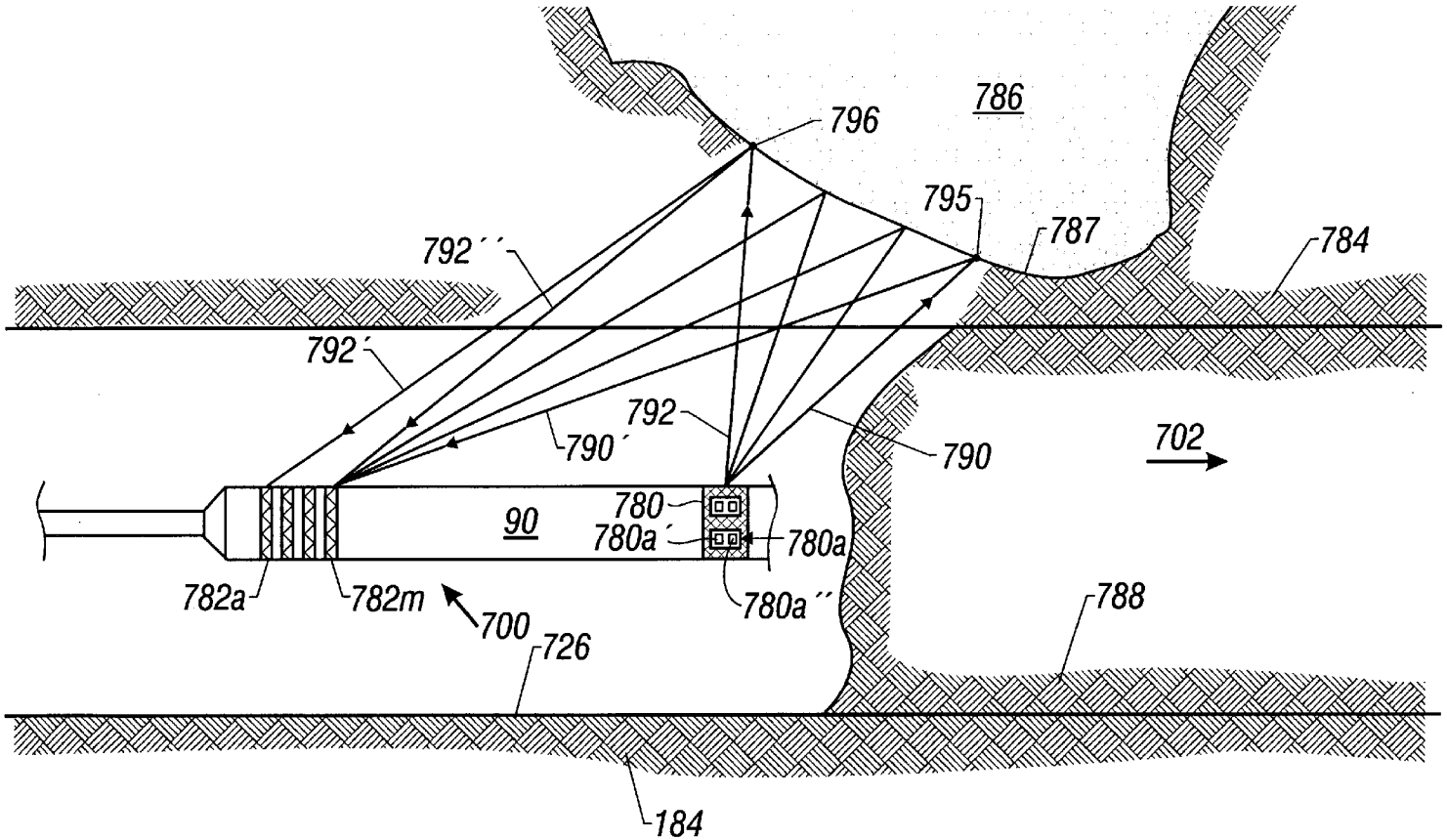
FIG. 9 is a schematic illustration of an acoustic device in the bottom hole assembly of the present invention to determine boundary conditions around and in front of the bottom hole assembly during the drilling of the wellbore.

As noted-earlier, the BHA 90 of the present invention preferably includes sensors that provide the bed boundary and geophysical information. The present invention preferably utilizes one or more acoustic arrangements to obtain such parameters. FIG. 9 shows an exemplary acoustic sensor arrangement 700 disposed on the BHA 90 that is conveyed in the borehole 26. The acoustic sensor 700 includes a transmitter array 780 having a plurality of circumferentially disposed transmitter elements 780*a*–780*n*. Each transmitter element may include two axially spaced segments, such as segments 780*a*' and 780*a*" of transmitter element 780*a*. Each such segment can be independently activated to transmit acoustic energy into the formation 784. A non-hydrocarbon bearing formation 786 lies a distance from the borehole 26 being formed in the pay zone 784 in the direction shown by arrow 702.

The transmitter elements are selectively fired to focus the acoustic energy in any desired direction. In the example of the FIG. 9, the acoustic energy is directed toward the formation 786. Acoustic energy can be focused by selecting the number and the relative firing timing of the transmitter segments. The acoustic energy 792, 795 and the like reflects from boundary of the formation 786 respectively as shown by rays 792', and 795'. This reflected energy is received or detected by the receivers 782*a*–782*m*. The receiver 782*a*–782*m* are processed by any known method in the art to determine the travel time of the received energy and the distance of the bed boundary 787 from the BHA 90. When the acoustic energy is focused downhole, it provides the bed boundary information in front of the wellbore 26. The acoustic energy transmitted radially provides bed boundary information around the BHA 90. The acoustic sensors in the BHA 90 can also be used to obtain seismic maps in response to acoustic signals generated at locations outside the borehole. The bed boundary and seismic information is used to update the drilling course and to maintain the drilling within the desired formation.

Figure 10A:
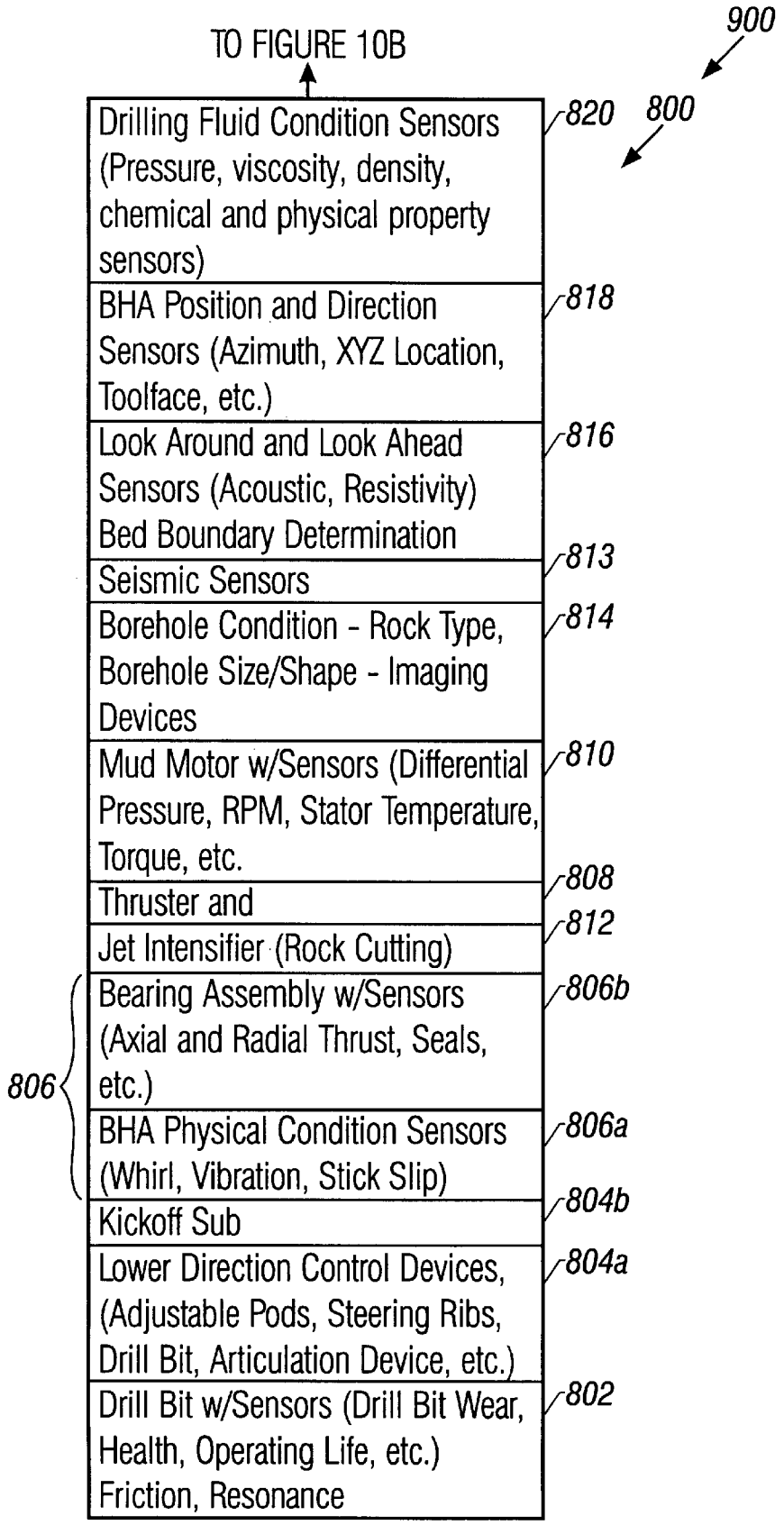
FIGS. 10A and 10B shows a schematic block diagram depicting the various elements of the integrated bottom hole assembly according to the present invention.
Figure 10B:
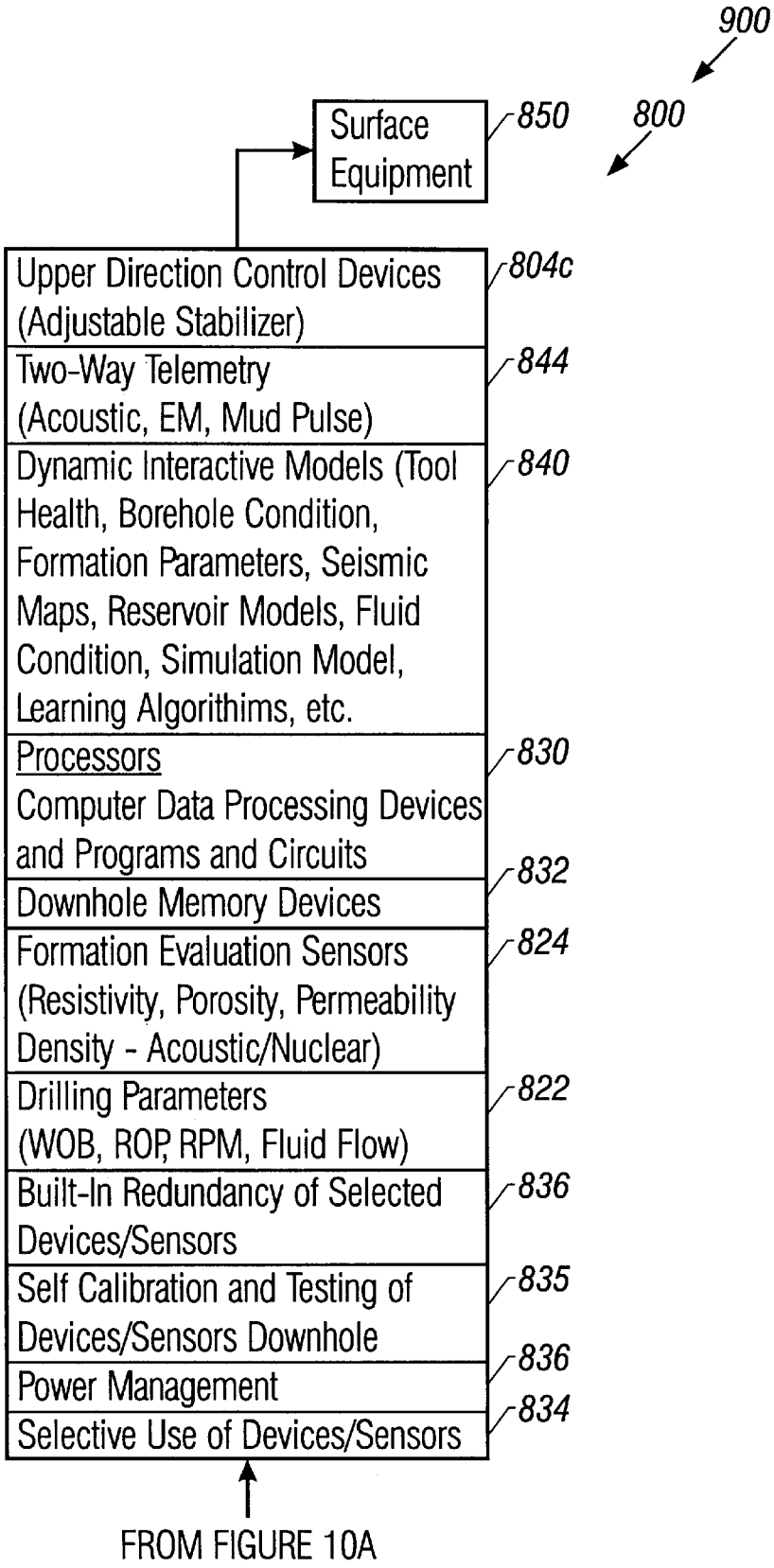
Figure 11A:
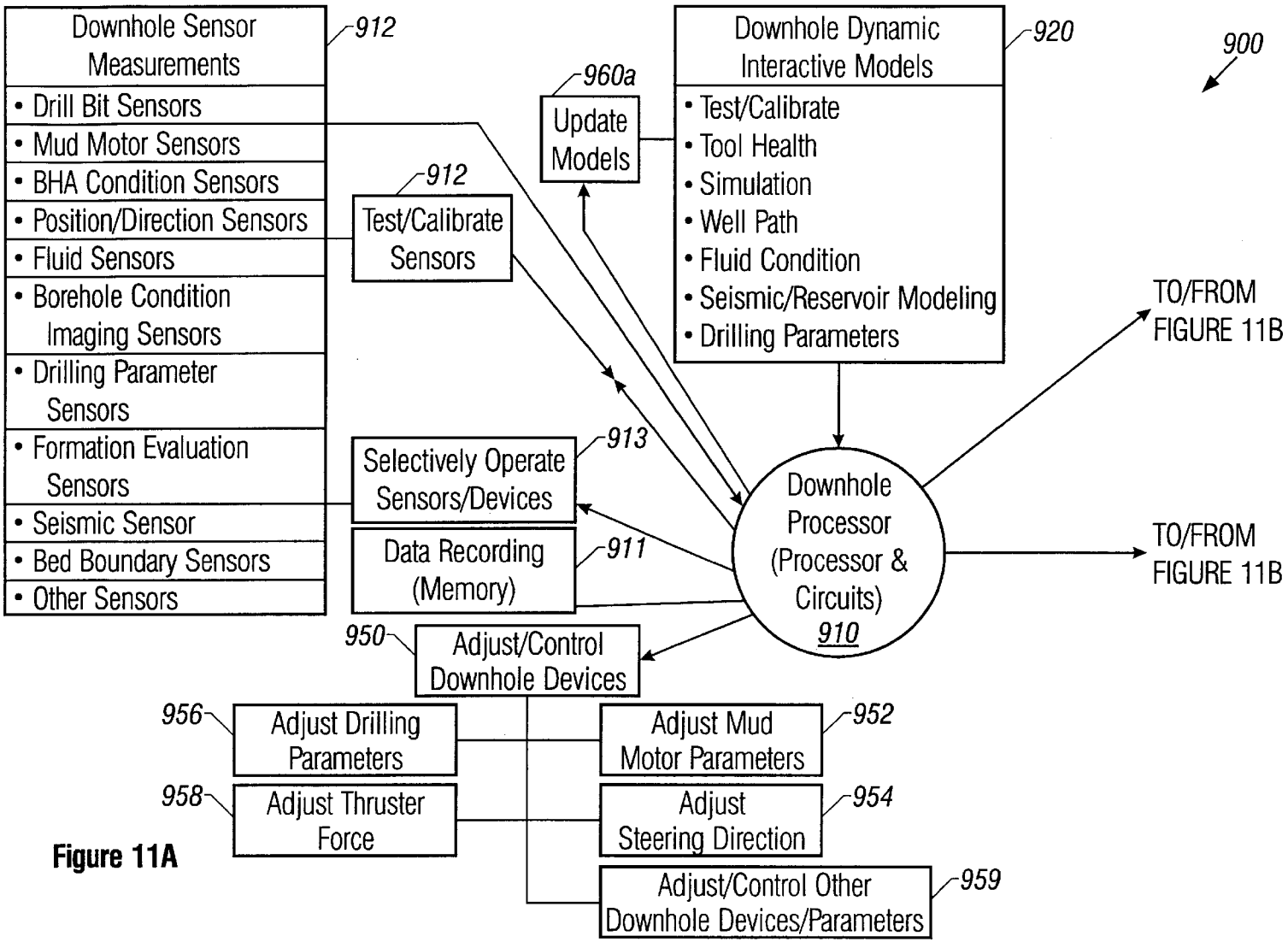
FIG. 11 a functional block diagram of the overall relationships of the various types of drilling, formation, borehole and drilling assembly parameters utilized in the drilling system of the present invention to effect automated closed-loop drilling operations of the present invention.
Figure 11B:
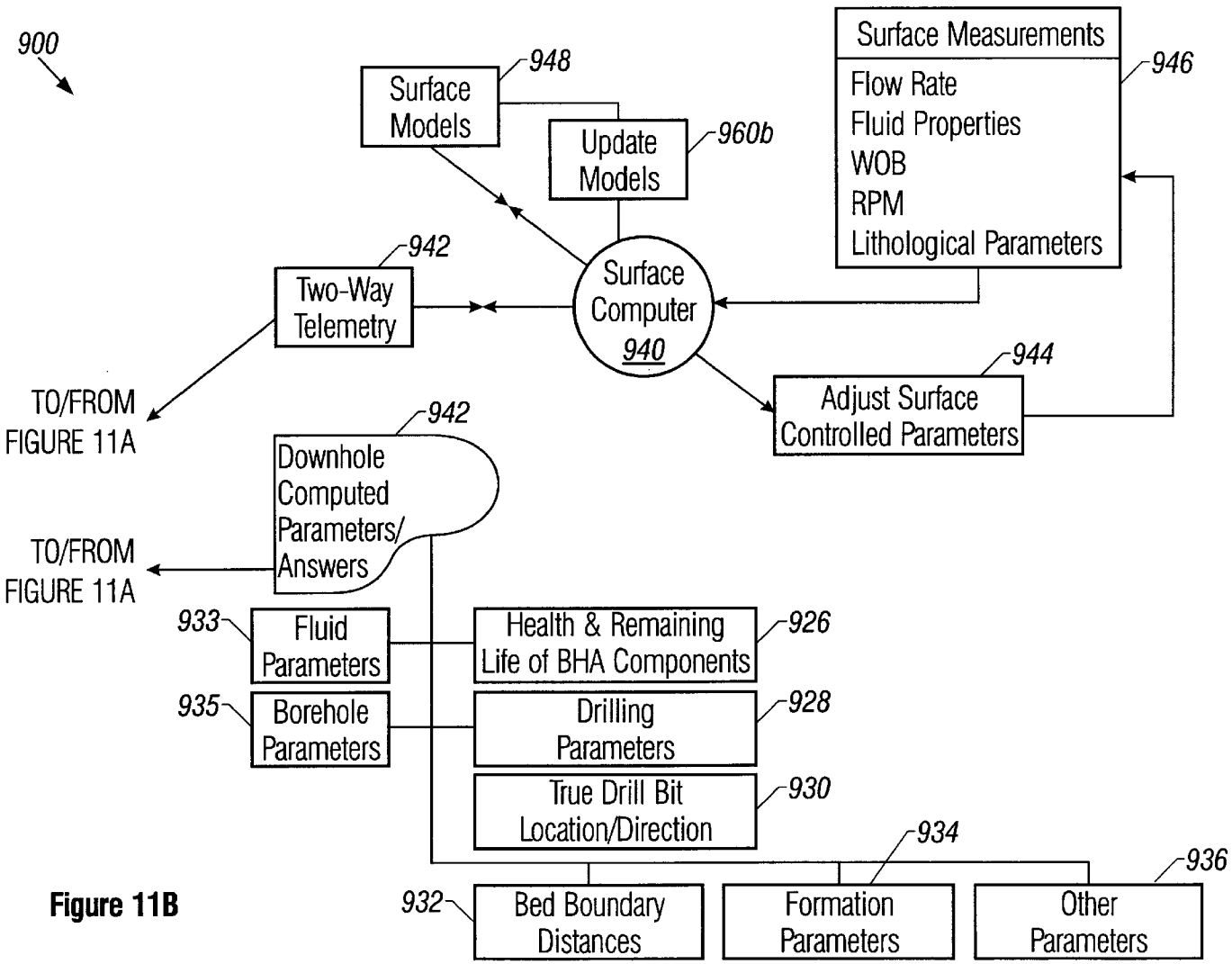

The description thus far has related to specific examples of the sensors and their placement in the BHA and certain preferred modes of operation of the drilling system. However, the overall objective of this invention is to provide an integrated BHA which is substantially self-contained and which utilizes a multitude of sensors, interactive and dynamic models, pre-existing data stored in the BHA, and information provided from the surface to optimize the drilling operations. The integrated BHA of the present invention forms an integral part the closed-loop drilling system of FIG. 1 which enables the operators to form oilfield wellbores with improved drilling effectiveness, i.e., better wellbores faster and more economically compared to the many currently used systems. This system results in forming wellbores at enhanced drilling rates (rate of penetration) with increased BHA assembly life. It should be noted that, in some cases, a wellbore can be drilled in a shorter time period by drilling certain portions of the wellbore at relatively slower ROP's because drilling at such ROP's prevents excessive BHA failures, such as motor wear, drill bit wear, sensor failures, thereby allowing greater drilling time between retrievals of the BHA from the wellbore for repairs or replacements. The overall configuration of the integrated BHA of the present invention and the operation of the drilling system containing such a BHA is described below. FIGS. 10A–10B show the major components of the BHA (BHA configuration) according to the present invention. FIG. 11 is a block functional diagram showing the overall operation of the drilling system of the present invention that utilizes the BHA shown in FIG. 10. Referring generally to FIGS. 1–11 and particularly to FIG. 10, the BHA 800 of the present invention is coupled to the surface equipment 850. The surface equipment 850 includes a drilling fluid source, apparatus that controls the weight on bit if a drill pipe is used, a motor for rotating the drill pipe, one or more computers which communicate with the BHA via a telemetry system 801, manipulate signals and data from the surface and downhole devices and control the surface drilling parameters and also may control certain operations of the BHA 800. The surface equipment 850 provides to the operator desired information on appropriate screens and other suitable formats.

For clarity and ease of understanding of the overall operations of the drilling system 900, the BHA 800 contents and configuration are first described with reference to FIG. 10. For simplicity, the major components of the BHA are shown in numbered boxes. The order of the boxes is not necessarily material. Referring generally to FIGS. 1–10 and particularly to FIG. 10, Box 802 shows that the BHA 800 includes a drill bit and one or more sensors that provide measurements relating to the drill bit parameters, such as the wear and other physical parameters of the drill bit. One or more lower directional control devices 804*a* are preferably disposed near the drill bit 802. The direction control devices include independently controlled stabilizers, downhole-actuated knuckle joints, bent housings, and bit orientation devices. The directional control devices 804*a* preferably include a device having independently operated extendable pads or steering ribs. In some applications, it may be desirable to include a drill bit orientation device as described in FIG. 4. A kick-off subassembly 804*b* may be disposed between the lower directional devices 804*a* and an upper directional device 804*c*, which may also be an adjustable pad-type device as described in reference to FIG. 4.

A number of position and direction sensors 818 are disposed at suitable locations in the BHA 800. Such sensors include three-axis accelerometer, gyroscopic devices, gamma ray devices and magnetometers. The position and direction parameters include the drill bit position, azimuth, inclination, BHA and drill bit orientation, and true x, y, and z coordinates of the drill bit 802. The system 900 maintains the desired drilling direction by controlling the operation of the direction control devices 804*a*–804*c*.

Bottom hole assembly condition parameter sensors 806 provide information about the physical condition of the BHA 800. Such sensors include sensors 806*a* that provide measurement for determining bit bounce, vibration, stick-slip, backward rotation, torque, shock, whirl, buckling, borehole and annulus pressure anomalies, excessive acceleration, stress, BHA and drill bit side forces, axial and radial forces, radial displacement, and pressure differential between drilling assembly inside and the wellbore annulus. It also includes sensors 806*b* in the bearing assembly that provide information about the axial and radial displacement of the bearing assembly and thus the BHA, and also may include sensors for determining the torque on the drill bit and oil level sensors (in case of sealed bearings) for determining the condition of sealed bearings. The physical condition sensors 806 may also include any other desired sensors that will aid in determining the physical condition of the BHA. For coiled-tubing and horizontal drilling applications, a thruster 808 is preferably included in the BHA 800 which applies the desired mechanical force on the drill bit 802. The thruster 808 preferably is adjusted automatically to apply the require force on the drill bit 802.

The mud motor section 810 includes the mud motor and sensors that provide pressure drop across the mud motor, the fluid flow rate through the mud motor, absolute pressure at one or more locations in the mud motor, torque, pressure difference between the mud motor inside and the annulus, mud motor rpm, temperature of the fluid passing through the mud motor, and the temperature profile of the elastomeric stator. The mud motor power output and mud motor efficiency are derived from such measurements. A pressure intensifier 812 may be included in the BHA 800 to discharge high pressure fluid at the drill bit 802 bottom to aid the cutting of the rock by the drill bit 802. The pressure intensifier 812 may be driven by the mud motor 810 or directly by the circulating drilling fluid or by another suitable mechanism. The borehole condition sensors, such as calipers or tactile devices to determine the borehole size, an imaging device (such as an ultra-sonic device or a tactile device) to determine the cracks and roughness of the borehole inside, etc. are shown by box 814.

The BHA 800 and the drill string of the system 900 contain drilling fluid sensors 820, which determine downhole the physical and chemical properties of the drilling fluid. Such sensors may include sensors for determining the pressure profile and temperature profile of the drilling fluid inside the tubing and the BHA and in the annulus, viscosity, density, compressibility, and rheology of the drilling fluid, the size and amount of the drill cuttings in the circulating fluid, cutting accumulation, chemical properties such as pH level and constituents of the drilling fluid (methane, gas, oil and water).

Boundary condition sensors 816 (also referred herein as the look-ahead and look-around sensors) may include resistivity, acoustic and other type of sensors for determining boundary conditions such as oil-water separation and formation bed boundaries around and in front of the drill bit 832. Sensors 816 provide the distance between BHA 800 and the adjacent bed boundaries. Additionally, seismic sensors 817 used in the BHA 800 provide geophysical data relating to the subsurface formations. The boundary condition information near the drill bit and the geophysical data is used to update the drilling path and to update preexisting seismic maps which are generally obtained at the surface prior to developing the oilfields.

Drilling parameter sensors 822 provide direct downhole measurement of the important drilling parameters of WOB, rpm, fluid flow rate etc. The formation evaluation sensors are denoted by the box 824 and include, among other things, sensors for determining the resistivity, dielectric constant, acoustic velocity, porosity, density and permeability of the formation being drilled. Formation evaluation sensors are known in the art and such sensors, in any combination, may be utilized for the purpose of this invention.

The BHA 800 includes a variety of downhole circuits and processors, generally referred to herein as the processor 830. The processor 830 processes sensor signals, manipulate data to compute parameters of interest and generally controls the various downhole devices and sensors in the BHA 800. The processor 830 may include one or more microprocessors or micro-controllers (also referred to herein as the computers) and data storage devices or memory 832. The processor 830 accesses the various algorithms and model 840 stored in the downhole memory 832 and communicates with the surface equipment 850 via a two-way telemetry 844.

The models 840 stored in the BHA include models and algorithm to determine the BHA condition or health, seismic maps, reservoir models, models to determine the desired or optimal drilling parameters, self-diagnostic or test routines, routines to determine the effect of the drilling fluid conditions on the drilling performance and models for determining the formation properties. These models are interactive, in that the BHA utilizes one or more of these models to compute the various properties of interest or answers and takes actions in response to such computed parameters. The models are dynamic in that they can be updated during the drilling operations or in-situ based on the real time information obtained downhole and/or provided from the surface processor 850. The circuits in 830 include circuits 835 that perform in-situ test of certain devices and sensor measurements for accuracy. The circuits 835 can be programmed or designed to calibrate out of calibration devices and/or provide signals to the processor 830, which in turn corrects or normalizes the measurements either before processing or corrects the corresponding computed parameters or answers.

The BHA 800 also includes certain redundant devices 826 which are activated when their corresponding primary element is inoperative. This may include redundant pressure and temperature sensors, transmitter and/or receivers for acoustic and resistivity devices, etc. The processor 830 can automatically switch on and switch off any desired device or sensor in the system and operate only those devices and sensors that are needed at a particular time during the drilling of the wellbore as shown by the box 834 labeled selective use of devices/sensors. The selective use of the devices and sensors utilizes less power compared to their continuous use and also increases their operating life. Such circuits are shown by the power management box 836.

FIG. 11 shows the overall functional relationships of the various aspects of drilling systems described above in reference to FIGS. 1–10. The operation of the drilling system 900 will now be described while referring to FIGS. 1–11 and particularly to FIGS. 10 and 11. To effect the drilling of a borehole, the BHA 800 (FIG. 10) is conveyed into the borehole by a suitable conveying member such as a drill pipe or a coiled-tubing. The initial drilling parameters, such as the fluid flow rate, rpm and WOB, etc. are input into the surface and the downhole computers, each such parameter having a predefined range of operation.

As the drilling starts, the downhole processor 910 receives the downhole sensor measurements 912, which include the measurements from the drill bit sensors, mud motor sensors, BHA condition sensors, borehole condition sensors, fluid sensors, drilling parameter sensors, formation evaluation sensors, seismic sensors, bed boundary (look-ahead and look-around) sensors and any other sensors disposed in the BHA 800. The processor 910, utilizing the test routines stored downhole tests the accuracy of the measurements of selected sensors and, if required, calibrates such sensors (as shown by box 912) or utilize the discrepancy information to correct the computed values of the affected parameters according to programmed instructions.

The processor 910, utilizing the appropriate one or more models from the downhole stored models 920, computes values of the various downhole parameters 924. The downhole stored models 920 may include test/calibrate routines, tool health models, wellbore path, seismic maps, reservoir models and drilling parameter models. The computed parameters of interest or answers 924 preferably include, the health and remaining life of selected BHA components 926 (drill bit, mud motor and other critical devices), the drilling parameters 928 (WOB or the thrust force, rpm, torque, and fluid flow rate, etc.) that will provide optimum drilling effectiveness for the given type of BHA, true drill bit or BHA location 930, bed boundary distances 932, fluid parameters 933, formation parameters 934 (specifically the formation resistivity, porosity, and density), borehole parameters, and any other required parameters 936.

The processor 910 communicates with the surface computer 940 via a twoway telemetry 942 and preferably transmits only selected answers to the surface computers 940. The transmitted answers preferably include the downhole computed drilling parameters 928, certain fluid properties 933, and selected formation parameters. If certain downhole computed drilling parameters 928 are out of their desired ranges, then the surface computer 940 makes appropriate adjustments to the drilling parameters (fluid flow rate, fluid properties, etc.) until the downhole computed drilling parameters fall back within their required ranges. The surface computer 940 compares the downhole computed drilling parameters 928 with the surface computed values 946 and determines the required changes adjustments to such parameters. The surface computer 940 includes a plurality of algorithms and models 948 and utilizes such models and the formation evaluation parameters, geophysical information and other downhole computed information to update the drilling path, perform reservoir modeling, determine formation lithology, rock type and the presence of hydrocarbons. The downhole processor 910 can be programmed to compute this information and provide it to the surface. However, due to the limited data transmission rate, it is desired to compute the answers downhole, store the answers in the memory 911 for later use, and only transmit information that is required by the surface computer 940 during the drilling operations. The surface computer 940 also can be programmed to alter or override any action of the downhole processor 910.

The processor 910 is programmed to operate only those devices and sensors that are required at any given time as shown by 913, which conserves the downhole generated power. The processor 910 adjusts or controls the downhole devices 950 so as to optimize the drilling effectiveness. It adjusts the mud motor parameters 952 (e.g. by adjusting the fluid flow through the mud motor by adjusting a bypass valve), controls the steering devices to control the drilling direction 954, controls downhole controllable drilling parameters 956, controls the force applied by a thruster 958, and other downhole devices 959.

In summary, the system 900 of the present invention utilizes the integrated BHA 800, which processes the downhole measurements, communicates with the surface computer, determines the optimum values of certain parameters, controls devices, updates models so as to perform the drilling operations at the optimum values. This system achieves drilling at enhanced drilling rates and with extended BHA life. It also allows the operator and/or the system 900 to simulate or predict the effect of changing the drilling parameters from their current levels on further drilling of the wellbore. The system 900 can thus look ahead in the drilling process and determine the optimum course of action. The system 900 may also be programmed to dynamically adjust any model or data base as a function of the measurements made during the drilling operations, as shown by boxes 960*a* and 960*b*. The models and data are also modified based on data from the offset wells, other wells in the same field and the well being drilled, thereby incorporating the knowledge gained from such sources into the models for drilling future wellbores.

The above-described process is continually or periodically repeated, thereby providing an automated closed-loop drilling system 900 fordrilling oilfield wellbores with enhanced drilling rates and with extended drilling assembly 800 life.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A bottom hole assembly ("BHA") for drilling an oilfield wellbore, comprising:

(a) a plurality of sensors carried by the BHA, including at least one BHA condition sensor for determining a physical condition of the BHA, at least one position sensor for determining position of BHA, and at least one drilling parameter sensor for determining a selected drilling parameter, each said sensor making measurements during the drilling of the wellbore;

(b) a plurality of interactive models in the BHA including at least one model each for manipulating downhole data relating to each sensor in said plurality of sensors; and (c) a processor carried by the BHA, said processor utilizing the plurality of interactive models for processing downhole the measurements from the plurality of sensors to determine a plurality of parameters of interest said processor causing a change of at least one drilling parameter in response to the parameters of interest to improve effectiveness of the drilling of the wellbore.

2. The bottom hole assembly of claim 1, wherein the sensors in said plurality of sensors are selected from a group consisting of (a) drill bit sensors, (b) sensors which provide parameters for a mud motor, (c) BHA condition sensors, (d) BHA position and direction sensors, (e) borehole condition sensors, (f) an rpm sensor, (g) a weight on bit sensor, (h)

formation evaluation sensors, (i) seismic sensors, (j) sensors for determining boundary conditions, (k) sensors which determine the physical properties of a fluid in the wellbore, and (l) sensors that measure chemical properties of the wellbore fluid.

3. The bottom hole assembly of claim 1, wherein the parameters of interest are selected from a group consisting of (a) health of selected BHA components, (b) mud motor parameters, including mud motor stator temperature, differential pressure across a mud motor, and fluid flow rate through a mud motor, (c) BHA condition parameters including vibration, whirl, radial displacement, stick-slip, torque, shock, vibration, bending moment, bit bounce, axial thrust, and radial thrust, (d) BHA position parameters, including BHA azimuth, BHA coordinates, BHA inclination and BHA direction, (e) a boundary location relative to the BHA, (f) formation parameters, including resistivity, dielectric constant, water saturation, porosity, density and permeability (f) borehole parameters, including borehole size, and borehole roughness, (g) geophysical parameters, including acoustic velocity and acoustic travel time, (h) borehole fluid parameters, including viscosity, density, clarity, rheology, pH level, and gas, oil and water contents, (i) a boundary condition, (j) physical properties of the borehole fluid, (k) chemical properties of the borehole fluid, (l) drilling parameters, including weight on bit, rate of penetration, drill bit r.p.m. and fluid flow rate, and (m) estimate of the remaining operating life of a BHA component.

4. The bottom hole assembly of claim 1, wherein the processor further performs an in-situ test of at least one sensor in the BHA to measure any error in the measurements of such sensor and in response to such measured error makes corrections by one of (a) calibrating the sensor prior to utilizing any measurement from such sensor, (b) correcting the measurement of the sensor before processing the measurements from such sensor, and (c) correcting any parameter of interest determined from the measurement of such sensor.

5. The bottom hole assembly of claim 1 further comprising a downhole controlled steering device.

6. The bottom hole assembly of claim 5, wherein said plurality of parameters of interest includes a desired drilling direction and the processor adjusts the steering device to cause the BHA to drill the wellbore in the desired direction.

7. The bottom hole assembly of claim 1, wherein the processor turns on and turns off sensors in the BHA according to a predetermined selection criteria, thereby conserving power and increasing the operating life of such sensors.

8. The bottomhole assembly of claim 1, wherein the processor updates at least one of the interactive models during the drilling of the wellbore based on the downhole computed parameters of interest.

9. The bottom hole assembly of claim 1 further comprising a plurality of devices selected from a group consisting of (a) a mud motor, (b) a thruster, (c) a steering device, and (d) a jet intensifier.

10. The bottom hole assembly of claim 9, wherein the processor controls the operation of the devices in the BHA.

11. The bottom hole assembly of claim 1 further comprising a two way telemetry system, said telemetry providing communication of data and signals between the BHA and a surface computer.

12. The apparatus of claim 1, wherein the drilling parameter changed is one of (i) thrust on a drill bit attached to the BHA; (ii) drilling fluid flow rate; and (iii) rotational speed of the drill bit.

13. The apparatus of claim 12, wherein the processor causes the drilling parameter to change prior to-further drilling of the wellbore to provide continued drilling at one of (i) enhanced rate of penetration; and (ii) with extended life of the BHA.

14. The apparatus of claim 12, wherein the processor further adjusts a device in the BHA during drilling of the BHA in response to the parameters of interest.

15. The apparatus of claim 14, wherein the device is for altering direction of drilling.

16. A drilling system for drilling an oilfield wellbore, comprising:

(a) a drill string having a bottom hole assembly ("BHA"), said bottom hole assembly comprising;

(i) a plurality of sensors carried by the BHA, including at least one BHA condition sensor for determining a physical condition of the BHA, at least one position sensor for determining position of BHA, and at least one drilling parameter sensor for determining a selected drilling parameter, each said sensor making measurements during the drilling of the wellbore;

(ii) a plurality of interactive models in the BHA including at least one model each for manipulating downhole data relating to each sensor in said plurality of sensors; and (iii) a processor carried by the BHA, said processor utilizing the plurality of interactive models for processing downhole the measurements from the plurality of sensors to determine a plurality of parameters of interest for use in altering at least one drilling parameter to improve effectiveness of the drilling of the wellbore with the BHA;

(b) a transmitter associated with the BHA for transmitting data relating to the plurality of parameters of interest to the surface; and (f) a computer at the surface, said computer receiving said data from the BHA and in response thereto adjusting at least one drilling parameter at the surface to improve the effectiveness of the drilling of the wellbore.

17. The system of claim 16, wherein the parameters of interest include a desired measure of at least one drilling parameter that will provide drilling of the wellbore at enhanced rate of penetration.

18. The system of claim 17, wherein the surface computer adjusts a device at the surface in response to the measure of the drilling parameter to achieve the drilling of the wellbore at the enhanced rate of penetration.

19. The system of claim 16, wherein said computer at the surface adjusts the at least one drilling parameter until said parameters of interest fall back within predetermined ranges defined for said parameters of interest.

20. The system of claim 16 further comprising at least one formation evaluation sensor.

21. The system of claim 20, wherein said at least one formation evaluation sensor includes at least one sensor selected from a group consisting of (i) a resistivity sensor, (ii) a sonic sensor, (iii) a nuclear sensor, and (iv) a nuclear magnetic resonance sensor.

22. The system of claim 16 further comprising at least one fluid sensor for determining downhole a property of drilling fluid supplied under pressure from the surface to the drill string and wherein said surface computer alter the at one drilling parameter in response to said determined property of the drilling fluid.

23. The system of claim 16 further comprising at lea one sensor for providing signals representative of a characteristic of formation ahead of said drill string and wherein said processing adjusts a drilling parameter or drilling direction in response to said characteristic of the formation.

24. The system of claim 16 further comprising at least one borehole condition sensor for determining a borehole condition, parameter and wherein said system adjusts the at least one drilling parameter in response to said determined borehole parameter.

25. The system of claim 16, wherein the processor calibrates downhole a selected number of sensors in said plurality of sensors prior to utilizing measurements from said plurality of sensors to determine said parameters of interest.

26. The system of claim 16, wherein at least one of the interactive models is a dynamic model that is updated downhole at least in part based on measurements made by at least one sensor in said plurality of sensors.

27. At The system of claim 16, wherein said inteactive models include at least one model selected from a group consisting of models relating to (i) test and calibration routines for the sensors carried by the BHA, (ii) health of the BHA, (iii) wellbore path, (iv) reservoir modeling, (v) drilling parameters, (vi) borehole condition, (vii) properties of fluid in the wellbore, (viii) characteristics of the formation penetrated by said BHA during drilling of the wellbore, and (ix) physical properties of the mud motor carried by the BHA.

28. The system of claim 16, wherein the at least one drilling parameter of interest is selected from a group consisting (i) weight on bit, (ii) rate of penetration of the BHA during drilling of the wellbore, (iii) fluid flow rate of drilling fluid supplied under pressure from the surface, (iv) torque on the drill string, and (v) rotational speed of the drill bit.

* * * * *